US009153403B2

(12) United States Patent
Sumino et al.

(10) Patent No.: US 9,153,403 B2
(45) Date of Patent: Oct. 6, 2015

(54) ELECTROMAGNET DEVICE

(71) Applicant: Omron Corporation, Kyoto-shi (JP)

(72) Inventors: Toshifumi Sumino, Katano (JP); Masaaki Yamamoto, Ibaraki (JP); Ichinori Sakai, Higashiomi (JP); Mitsuhiro Kawai, Ibaraki (JP); Shinichi Furusho, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/953,995

(22) Filed: Jul. 30, 2013

(65) Prior Publication Data

US 2014/0055220 A1 Feb. 27, 2014

(30) Foreign Application Priority Data

Aug. 24, 2012 (JP) ..... 2012-185901

(51) Int. Cl.

| | |
|---|---|
| ***H01H 67/02*** | (2006.01) |
| ***H01H 50/36*** | (2006.01) |
| ***H01F 7/08*** | (2006.01) |
| ***H01F 7/122*** | (2006.01) |
| ***H01F 7/14*** | (2006.01) |

(52) U.S. Cl.

CPC ..... *H01H 50/36* (2013.01); *H01F 7/081* (2013.01); *H01F 7/122* (2013.01); *H01F 7/14* (2013.01)

(58) Field of Classification Search

CPC ..... H01H 50/642
USPC ..... 335/78–79
See application file for complete search history.

(56) References Cited

U.S. PATENT DOCUMENTS

| | | | | |
|---|---|---|---|---|
| 2,702,841 | A | 2/1955 | Bernstein | |
| 3,195,023 | A * | 7/1965 | Mielert et al. | 335/230 |
| 3,599,133 | A * | 8/1971 | Richert | 335/230 |
| 3,775,715 | A | 11/1973 | Bosch | |
| 4,020,434 | A * | 4/1977 | Jaegle et al. | 335/230 |
| 4,339,734 | A * | 7/1982 | Minks | 335/78 |
| 4,498,065 | A * | 2/1985 | Nagamoto et al. | 335/79 |
| 4,728,917 | A * | 3/1988 | Kimpel | 335/274 |
| 5,574,416 | A * | 11/1996 | Maruyama et al. | 335/78 |

(Continued)

FOREIGN PATENT DOCUMENTS

| | | |
|---|---|---|
| DE | 1035273 B | 7/1958 |
| DE | 3140374 A1 | 4/1983 |

(Continued)

OTHER PUBLICATIONS

Extended European Search Report for corresponding application EP13178733; Report dated Aug. 11, 2014.

*Primary Examiner* — Alexander Talpalatski
(74) *Attorney, Agent, or Firm* — Klarquist Sparkman, LLP

(57) ABSTRACT

The present invention provides an electromagnet device including a horizontal portion of a yoke arranged near one end portion of an iron core, a movable iron piece which pivotably supported on a leading end edge portion of a vertical portion of the yoke which serves as a fulcrum, an end portion of the movable iron piece adapted to be attracted to a magnetic pole portion by a main magnetic circuit, the magnetic pole portion is arranged in the other end portion of the iron core. The main magnetic circuit is formed by applying a voltage to a coil wound around a periphery of the iron core and an auxiliary magnetic circuit formed in parallel with the main magnetic circuit, the auxiliary circuit including a permanent magnet is arranged near the one end portion of the iron core and a magnetic resistance portion, in which a magnetic flux of the permanent magnet is magnetically saturated.

20 Claims, 19 Drawing Sheets

(56) References Cited

U.S. PATENT DOCUMENTS

| | | | | |
|---|---|---|---|---|
| 5,864,271 | A * | 1/1999 | Mader | 335/78 |
| 6,940,375 | B2 * | 9/2005 | Sanada et al. | 335/86 |
| 2012/0206223 | A1 * | 8/2012 | Tan | 335/189 |

FOREIGN PATENT DOCUMENTS

| | | | |
|---|---|---|---|
| DE | 3438275 | C1 | 11/1989 |
| EP | 0686989 | A1 | 12/1995 |
| GB | 2137813 | A | 10/1984 |

* cited by examiner

ELECTROMAGNET DEVICE

CROSS REFERENCE TO RELATED APPLICATION

This application claims benefit of priority to Japanese Patent Application No. 2012-185901, filed on Aug. 24, 2012 of which the full contents are herein incorporated by reference.

BACKGROUND OF THE INVENTION

The present invention relates to an electromagnet device.

Conventionally, as an electromagnet device used for a latching type electromagnetic relay, for example, there is an electromagnet device used for "a magnetic retaining relay that attracts and retains a movable iron piece, resisting against a return spring, using residual magnetization of a magnetic circuit which is constructed of an iron core with a coil wound around, an iron core frame, and a movable iron piece, in which the iron core is made of an electromagnetic soft iron material, or a steel material with a carbon content of 0.01% or less, and the iron core frame is made of a semi-hard magnetic material" (refer to Japanese Utility Model Publication No. 1983-157947).

In the electromagnet device, the iron core frame is made of a semi-hard magnetic material. However, for example, when such an electromagnet device is applied to an electromagnetic relay for which a large switching load is required, it is not easy to drive a movable touch piece having a strong spring force. In particular, since a strong retention force is needed to retain the movable iron piece which is in a moved state thereby practical application of such an arrangement is difficult.

SUMMARY OF THE INVENTION

Accordingly, the present invention provides an electromagnetic device which overcomes the above-mentioned problems and limitations of conventional art. Further, the present invention provides an electromagnet device in which a movable iron piece easily moves and which has a retention force for maintaining a returned state and a moved state of the movable iron piece, and an electromagnetic relay using the electromagnet device.

In accordance with one aspect of the present invention, there is provided an electromagnet device comprising a horizontal portion of a yoke arranged near one end portion of an iron core, a movable iron piece pivotably supported on a leading end edge portion of a vertical portion of the yoke. The vertical portion of the yoke serves as a fulcrum. Further, the electromagnetic device comprising an end portion of the movable iron piece adapted to be attracted to a magnetic pole portion by a main magnetic circuit. The magnetic pole portion is arranged in the other end portion of the iron core and the magnetic circuit is formed by applying a voltage to a coil wound around a periphery of the iron core. Also, the electromagnetic device comprising an auxiliary magnetic circuit formed to be in parallel with the main magnetic circuit. The auxiliary magnetic circuit comprises a permanent magnet arranged near the one end portion of the iron core and a magnetic resistance portion where a magnetic flux of the permanent magnet is magnetically saturated.

In accordance with one of the preferred embodiments of the present invention, the auxiliary magnetic circuit may be formed as a structure in which the permanent magnet is interposed between an auxiliary yoke which is fixed to the one end portion of the iron core and the horizontal portion of the yoke, and at least one narrow-width portion which serves as a magnetic resistance portion. Further, the at least one narrow-width portion has a small cross-sectional area as compared with a cross section of a base portion of the auxiliary yoke and it extends sideways from one end of the auxiliary yoke and joined to the vertical portion of the yoke.

In accordance with another preferred embodiment of the present invention, the auxiliary magnetic circuit comprises a pair of the narrow-width portions extend sideways in parallel with each other from the one end of the auxiliary yoke and is joined to the vertical portion of the yoke.

In accordance with yet another preferred embodiment of the present invention, the auxiliary magnetic circuit further comprises of the horizontal portion of the yoke and the vertical portion of the yoke which are prepared as separate bodies, and the auxiliary yoke fixed to the one end portion of the iron core, the auxiliary yoke integrally extends from an end portion of the vertical portion of the yoke via a narrow-width portion. The narrow-width portion serves as a magnetic resistance portion and has a small cross-sectional area as compared with a cross section of a base portion of the auxiliary yoke. Further, the auxiliary magnetic circuit has the permanent magnet which is interposed between the horizontal portion of the yoke and the auxiliary yoke.

In accordance with still another preferred embodiment of the present invention, the auxiliary magnetic circuit comprises the one end portion of the iron core is fixed to the horizontal portion of the yoke which extends from an end portion of the vertical portion of the yoke via a narrow-width portion. The narrow-width portion serves as a magnetic resistance portion and has a small cross-sectional area as compared with a cross section of a base portion of the yoke. Further, the auxiliary magnetic circuit has the permanent magnet which is interposed between the horizontal portion of the yoke and the auxiliary yoke which is joined to a leading end face of the vertical portion of the yoke.

In accordance with another preferred embodiment of the present invention, the auxiliary magnetic circuit comprises the one end portion of the iron core is fixed to the horizontal portion of the yoke which extends sideways from an end portion of the vertical portion of the yoke via a narrow-width portion. The narrow-width portion serves as a magnetic resistance portion and has a small cross-sectional area as compared with a cross section of a base portion of the yoke. Further, the auxiliary magnetic circuit has permanent magnet which is interposed between the horizontal portion of the yoke and the auxiliary yoke having an end portion joined to an end face of the vertical portion of the yoke.

In accordance with another preferred embodiment of the present invention, the auxiliary magnetic circuit comprises the permanent magnet is interposed between the auxiliary yoke fixed to the one end portion of the iron core, and the horizontal portion of the yoke. Further, an end portion of the auxiliary yoke and a leading end portion of the horizontal portion are connected to each other via an auxiliary member provided with a narrow-width portion. The narrow-width portion serves as a magnetic resistance portion and has a small cross-sectional area as compared with a cross section of a base portion of the auxiliary yoke. The auxiliary magnetic circuit comprises the permanent magnet is interposed between the auxiliary yoke fixed to the one end portion of the iron core, and the horizontal portion of the yoke, and an end portion of the auxiliary yoke and a leading end portion of the horizontal portion are connected to each other via a narrow-width portion, which serves as a magnetic resistance portion and has a small cross-sectional area as compared with a cross section of a base portion of the auxiliary yoke.

In accordance with yet another preferred embodiment of the present invention, the one end portion of the iron core may be used as a magnetic resistance portion and has a small cross-sectional area as compared with a cross section of a base portion of the iron core, and the auxiliary magnetic circuit comprises of the permanent magnet interposed between the horizontal portion of the yoke and the auxiliary yoke, the permanent magnet has an annular shape, the iron core is inserted and passed through the permanent magnet via a through-hole of the auxiliary yoke, and the one end portion of the iron core which is passed through is fixed to the horizontal portion of the yoke.

In accordance with still another preferred embodiment of the present invention the one end portion of the iron core may be used as a magnetic resistance portion and has a small cross-sectional area as compared with a cross section of a base portion of the iron core, and the auxiliary magnetic circuit comprises of the permanent magnet interposed between the horizontal portion of the yoke and the auxiliary yoke and one end portion of the iron core inserted and passed through a through hole of the auxiliary yoke and is fixed to the horizontal portion of the yoke.

In accordance with another preferred embodiment of the present invention the one end portion of the iron core may be used as a magnetic resistance portion and has a small cross-sectional area as compared with a cross section of a base portion of the iron core, and the auxiliary magnetic circuit comprises of the one end portion of the iron core inserted and passed through the permanent magnet, the permanent magnet has an annular shape, and fixed to the horizontal portion of the yoke.

In accordance with another aspect of the present invention an electromagnetic relay is provided. The electromagnetic relay is constructed so that a contact mechanism is arranged to be adjacent to the electromagnet device and the contact mechanism is driven via a card connected to a movable iron piece of the electromagnet device.

BRIEF DESCRIPTION OF THE DRAWINGS

The invention will become more readily appreciated and understood from the following detailed description of preferred embodiments of the invention when taken in conjunction with the accompanying drawings, in which.

DETAILED DESCRIPTION

Figure 1A:
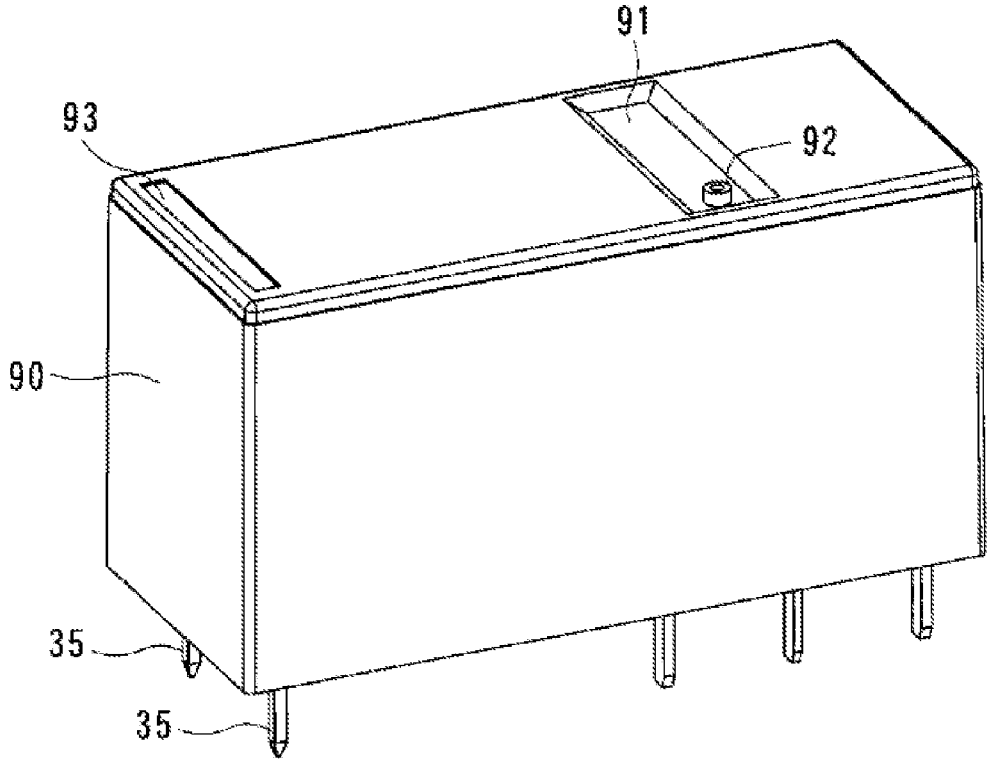
FIGS. 1A and 1B are perspective views of an electromagnetic relay incorporating an electromagnet device according to a first embodiment of the invention.
Figure 1B:
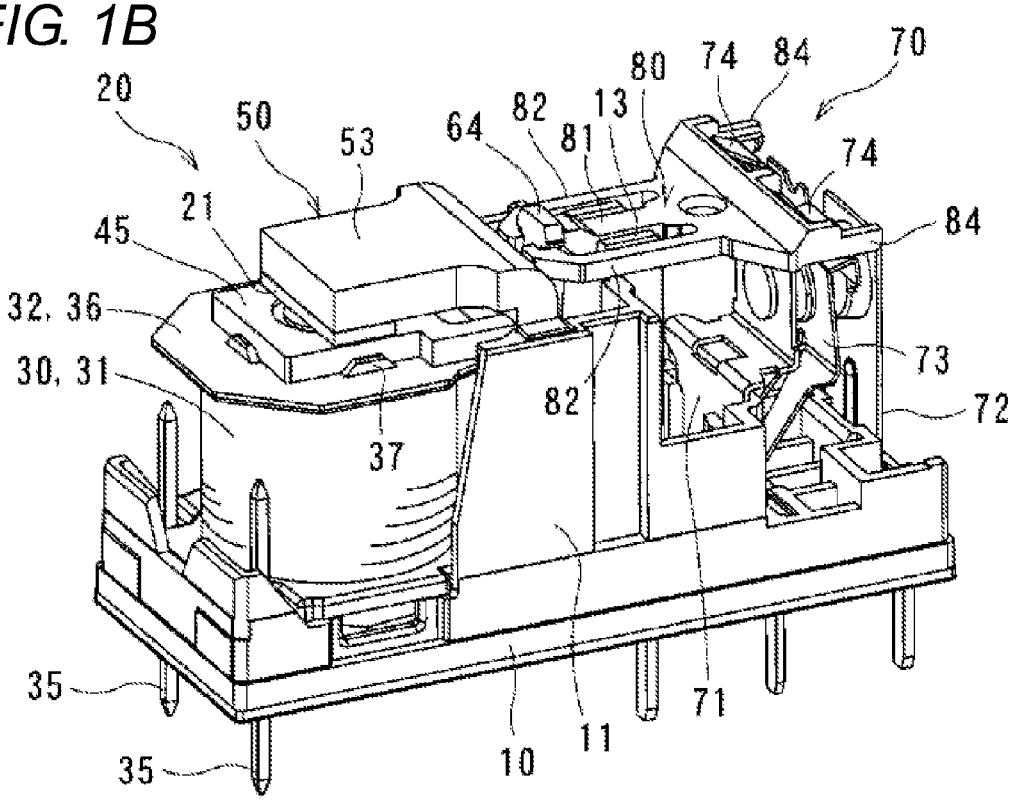

The present invention is described hereinafter by various embodiments with reference to the accompanying drawings, wherein reference numerals used in the accompanying drawings correspond to the like elements throughout the description. Further, while discussing various embodiments, cross reference will made between the figures. In order to achieve full description and explanation, specific details have been mentioned to provide thorough and comprehensive understanding of various embodiments of the present invention. However, said embodiments may be utilized without such specific details and in various other ways broadly covered herein.

Preferred embodiments of an electromagnet device according to the invention are described below with reference to FIGS. 1A to 22B.

An electromagnet device according to a first embodiment is incorporated into a latching type electromagnetic relay as illustrated in FIGS. 1A to 9B. In this case, the electromagnet relay includes a base 10, an electromagnet device 20, a contact mechanism 70, a card 80 and a box-shaped cover 90. Further, the card 80 is connected to the electromagnet device 20 and drives the contact mechanism 70.

Figure 2:
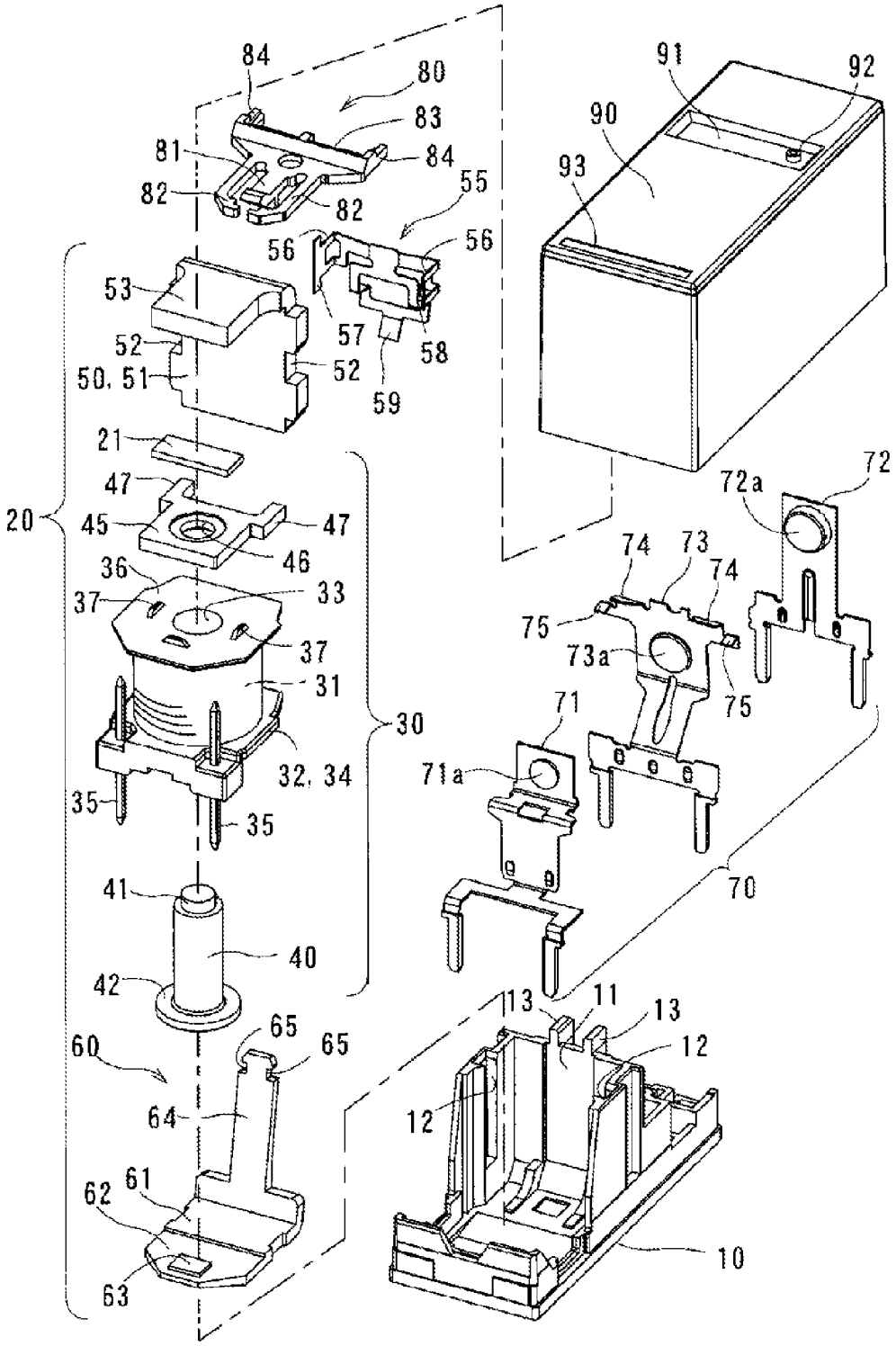
FIG. 2 is an exploded perspective view of the electromagnetic relay, illustrated in FIG. 1, which is obliquely viewed from the top.
Figure 3:
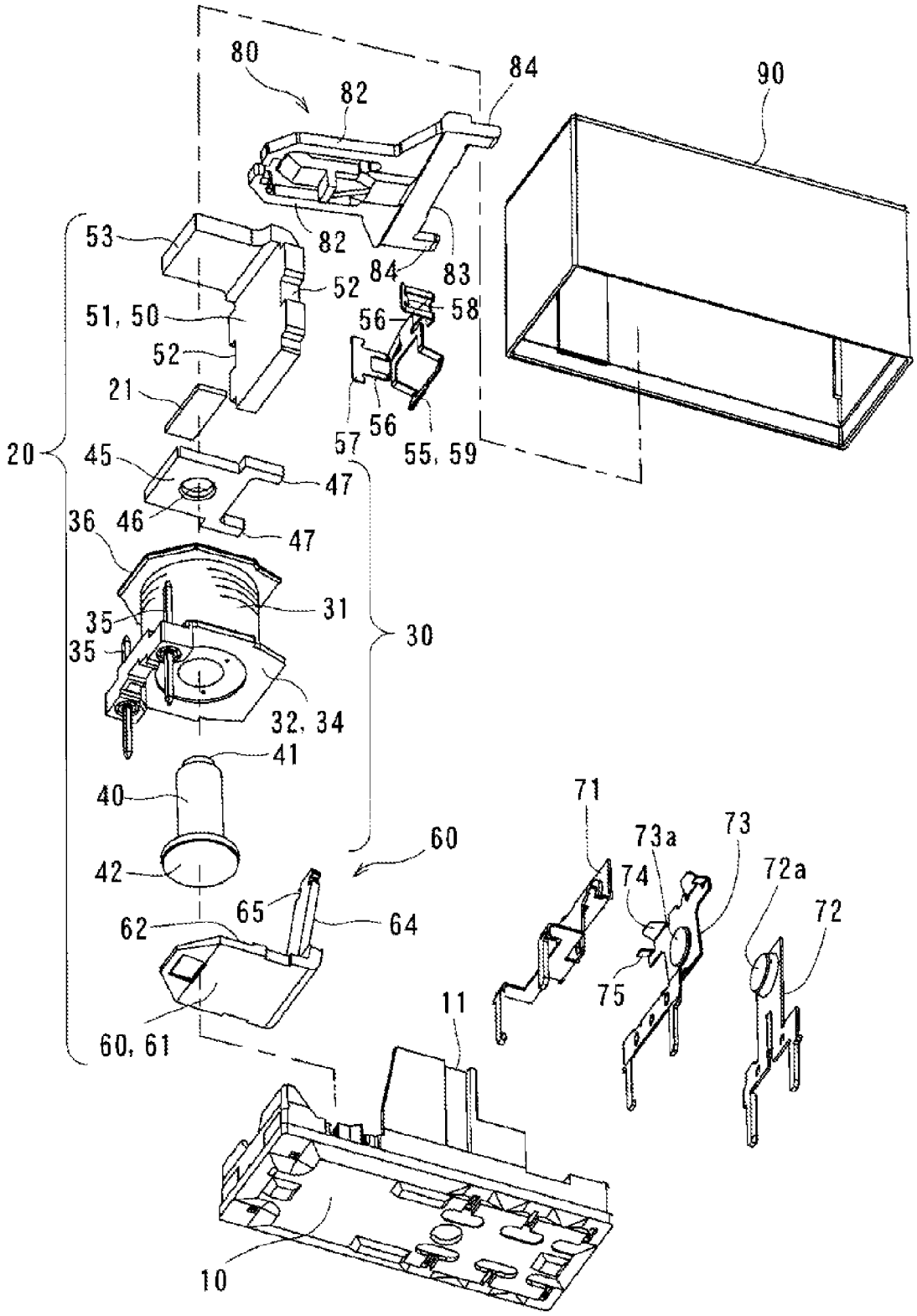
FIG. 3 is an exploded perspective view of the electromagnetic relay, illustrated in FIG. 1, which is obliquely viewed from the bottom.

As illustrated in FIG. 2 and FIG. 3, the base 10 has an approximately C-shaped insulation wall 11 which protrudes upward from an upper surface of the base 10 and is located at a center portion on the upper surface. In addition, the electromagnet device 20 described below is arranged on one side portion on the upper surface, and the contact mechanism 70 is arranged on the other side portion on the upper surface. The insulation wall 11 includes fitting grooves 12 which are formed in both inside surfaces, respectively which face each other. In the fitting grooves 12, both side edge portions of a yoke 50 are press-fitted. In addition, a center portion of an upper end of the insulation wall 11 is provided with a pair of guide ribs 13 that are in parallel with each other and protrude from an upper surface thereof.

Figure 4A:
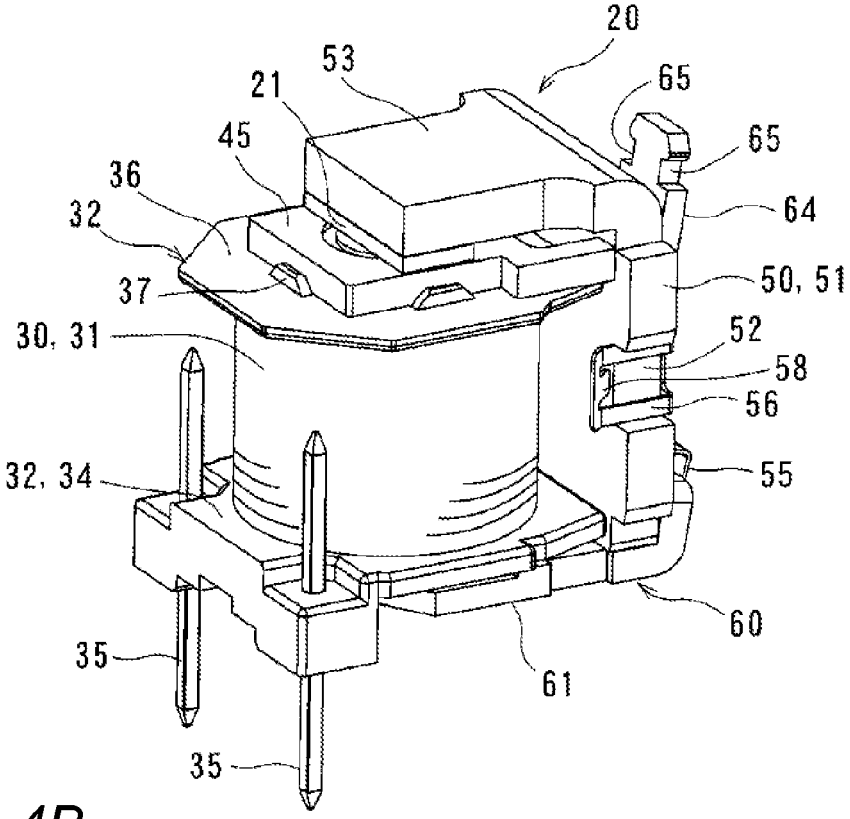
FIGS. 4A and 4B are perspective views illustrating the electromagnet device according to the first embodiment of the invention.
Figure 4B:
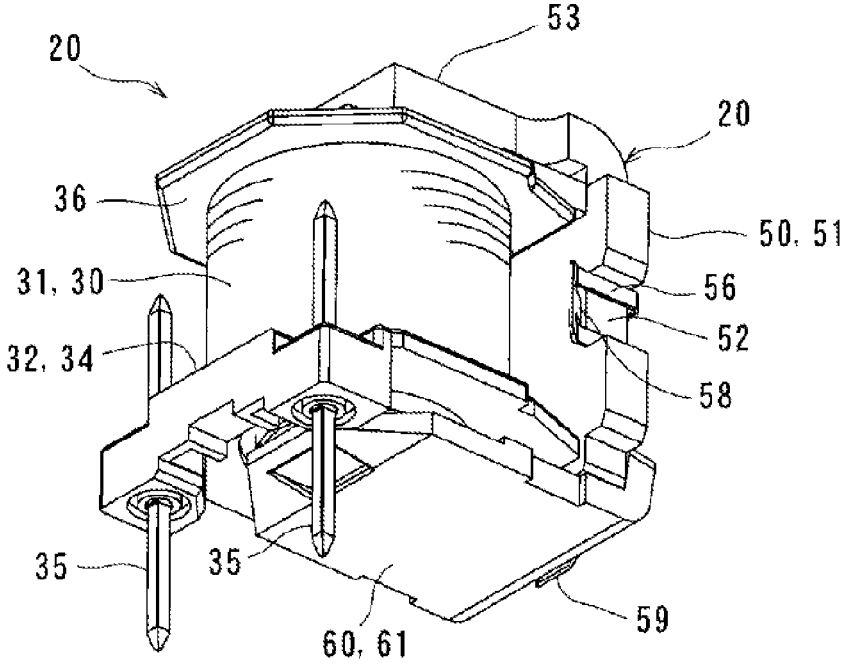
Figure 5:
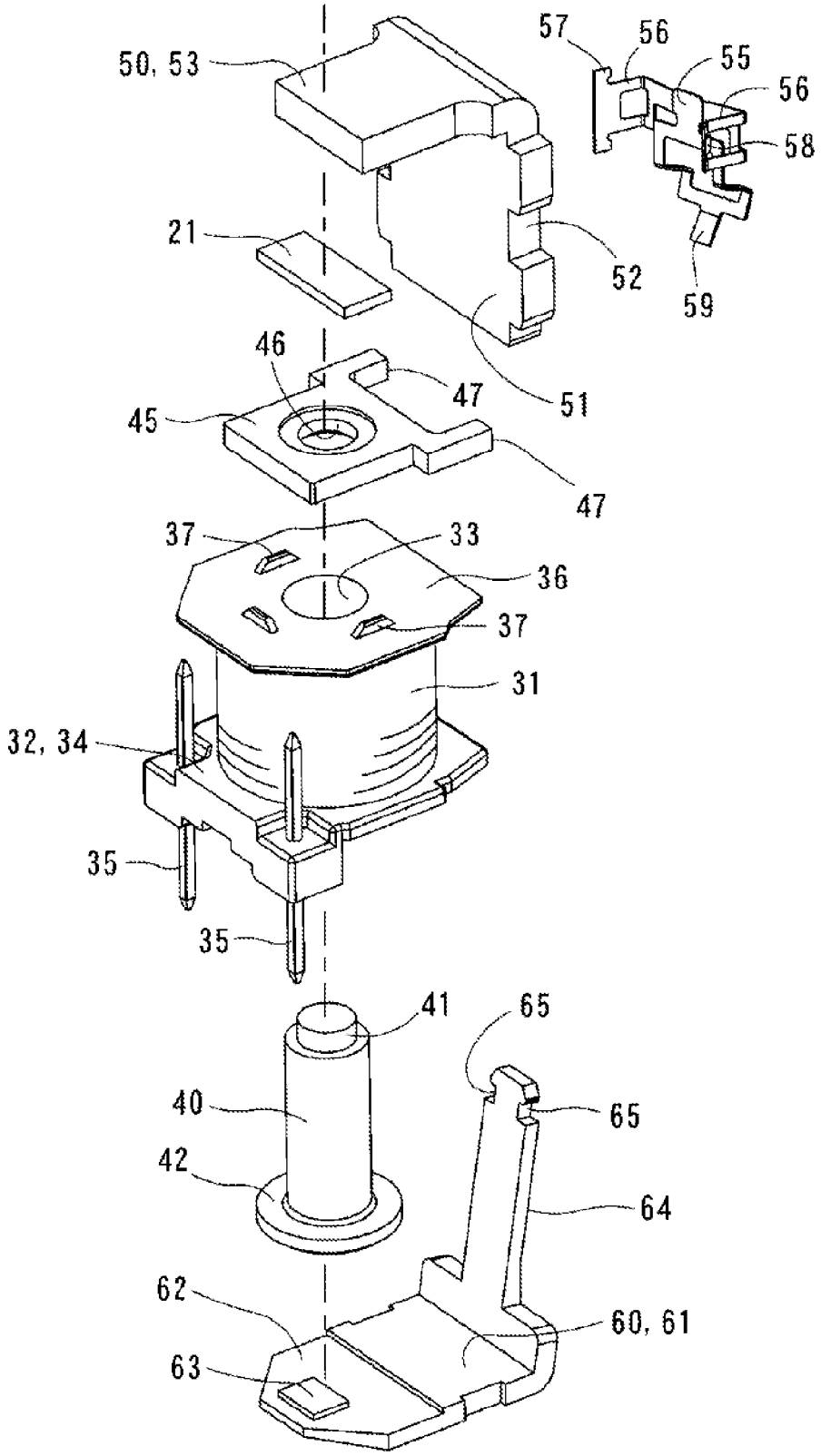
FIG. 5 is an exploded perspective view of the electromagnet device, shown in FIG. 4A, which is obliquely viewed from the top.

As illustrated in FIGS. 4A, 4B, and 5, the electromagnet device 20 includes an electromagnet block 30 in which an iron core 40 having an almost T-shaped cross section extends through a central hole 33 of a spool 32 around which a coil 31 is wound, and an auxiliary yoke 45 is caulking-fixed to an upper end portion 41 of the iron core 40 which is passed through the central hole 33. The electromagnet device 20 further includes a yoke 50 having an almost L-shaped cross section which is assembled so that a permanent magnet 21 is interposed between the yoke 50 and an upper end face of the iron core 40, a support spring 55 attached to a rear surface of the yoke 50, and a movable iron piece 60 which is pivotably supported on a lower end face edge portion of the yoke 50 via the support spring 55. The lower end face edge portion of the yoke 50 serves as a fulcrum for pivoting the movable iron piece 60.

In the spool 32, extended wires of the coil 31 are connected and soldered to coil terminals 35 which are press-fitted in corner portions of a guard portion 34. In the spool 32, alignment protrusions 37 for aligning a position of the auxiliary yoke 45 are formed to protrude from an upper surface of an upper guard portion 36.

The auxiliary yoke 45 has a caulking hole 46 in the center. In the auxiliary yoke 45, connecting narrow-width portions 47 having a small cross-sectional area compared with a cross section of a base portion (a wide-width portion without including the caulking hole 46) of the auxiliary yoke 45, extends in parallel with each other from adjacent corner portions of the auxiliary yoke 45, respectively. Further, the narrow width portions are magnetic resistance portions.

The permanent magnet 21 has a width dimension substantially the same as a width dimension of the auxiliary yoke 45.

The yoke 50 has an almost L-shaped cross section and includes a vertical portion 51 provided with notch portions 52 which are formed at both sides of the vertical portion 51, respectively. The notch portions 52 function to elastically engage the support spring 55 as described below. The yoke 50 further includes a horizontal portion 53 which laterally extends from an upper end of the vertical portion 51.

Figure 6:
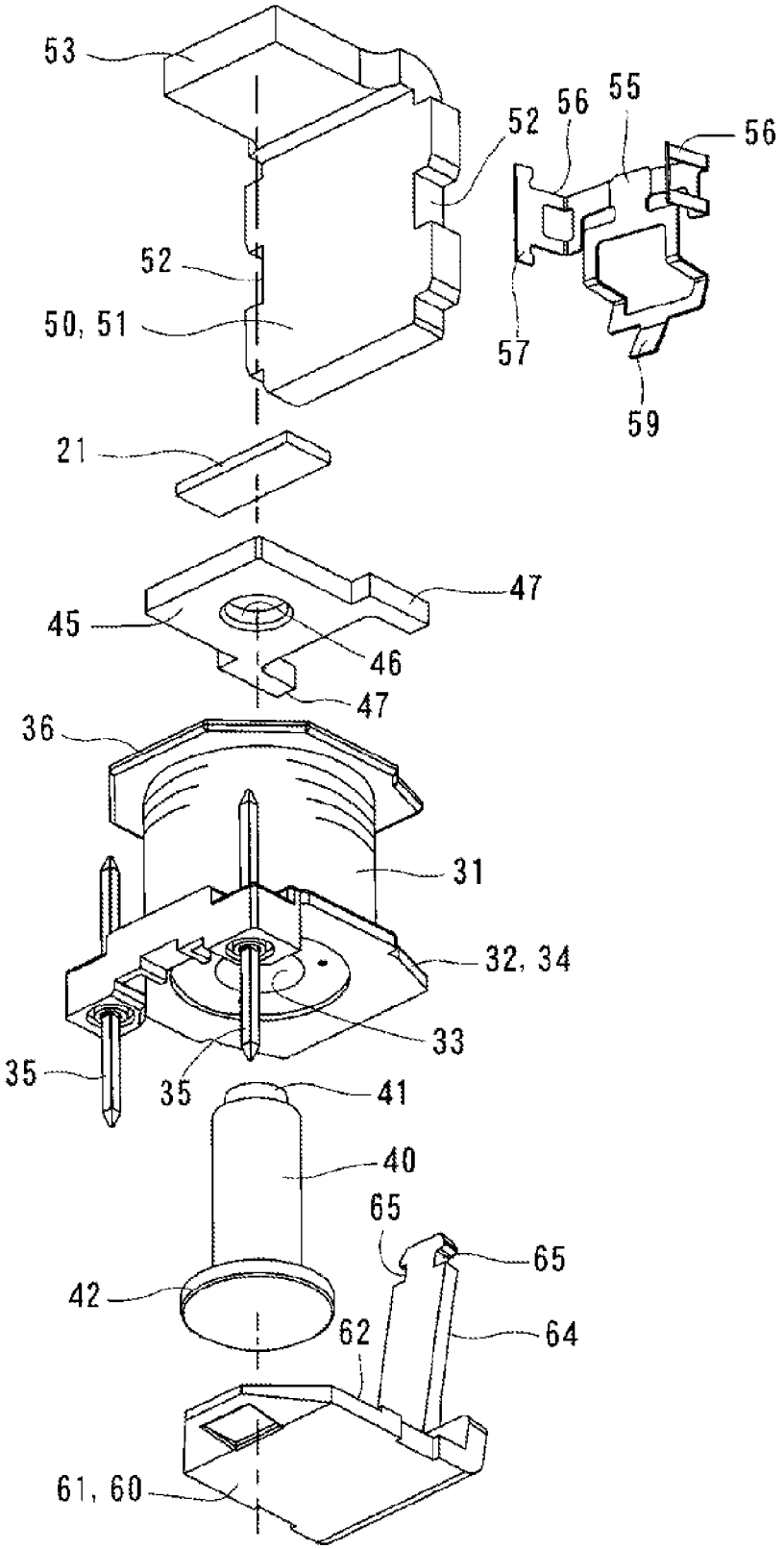
FIG. 6 is an exploded perspective view of the electromagnet device, illustrated FIG. 4B, which is obliquely viewed from the bottom.

As illustrated in FIGS. 5 and 6, in the support spring 55, a pair of elastic arm portions 56 extends in parallel with each other from both side edges of the support spring 55, respectively and an elastic support portion 59 extends from a lower edge portion of the support spring 55. While an engaging pawl 57 is formed to protrude from a leading end of either of the elastic arm portions 56, a latching pawl 58 is formed to stand up from a leading end of the other elastic arm portion 56.

In the movable iron piece 60, a step portion 62 which is one step lower than other portions is formed in a front half portion on an upper surface of the horizontal portion 61, and a contact protrusion 63 is formed in the step portion 62 through a protruding process. The movable iron piece 60 has notch portions 65 for engaging the card 80 as described below, at both side edges of a leading end portion of the vertical portion 64 of the movable iron piece, respectively.

As illustrated in FIGS. 2 and 3, the contact mechanism 70 includes first and second fixed touch pieces 71, 72 which are arranged to face each other at a predetermined distance, and a movable touch piece 73 arranged between the first and second fixed touch pieces 71, 72. A movable contact 73*a* provided in the movable touch piece 73 which is arranged to be alternately attachable to and detachable from a first fixed contact 71*a* and a second fixed contact 72*a*. The first and the second fixed contact 71*a*, 72 are provided in the first and second fixed touch pieces 71, 72, respectively. Two sets of latching pawls 74, 75 for vertically latching a remaining end edge portion 83 of the card 80 described below are formed in an upper end portion of the movable touch piece 73 by a cutting process.

As illustrated in FIGS. 2 and 3, in the card 80, a pair of elastic arm portions 82 and 82 extend from both sides of the contact protrusion 81, respectively that protrudes from one end, and a pair of latching arm portions 84 and 84 extend from both ends of the remaining end edge portion 83, respectively.

The box-shaped cover 90 has a box shape which can fit into the base 10. The box-shaped cover 90 is provided with a position-regulating projecting portion 91 that bulges downward from the ceiling (refer to FIGS. 7A and 7B) thereof, and a degassing hole 92 provided in the bottom of the position-regulating projecting portion 91. The position-regulating projecting portion 91 prevents the card 80 aligned under the position-regulating projecting portion 91 from lifting. The box-shaped cover 90 has a marking recess 93 in an end portion of an upper surface thereof.

Therefore, when assembling the electromagnetic relay, first, the permanent magnet 21 may be interposed between the horizontal portion 53 of the yoke 50 and the auxiliary yoke 45 of the electromagnet block 30 and the movable iron piece 60 is aligned with the lower edge portion of the vertical portion 51 of the yoke 50. Further, the movable iron piece 60 is pivotably supported on the yoke 50 in such a manner that the engaging pawl 57 and the latching pawl 58 are engaged with and latched to the notch portions 52 of the yoke 50, respectively. Both side edge portions of the yoke 50 are press-fitted in the fitting grooves 12 provided in the inside surfaces of the insulation wall 11 of the base 10.

On the other hand, the second fixed touch piece 72, the movable touch piece 73, and the first fixed touch piece 71 of the contact mechanism 70 are press-fitted in the other side in the upper surface of the base 10. Further, the other side in the upper surface which is partitioned by the insulation wall 11. Subsequently, the contact protrusion 81 of the card 80 is brought into contact with the vicinity of an upper end portion of the movable iron piece 60, and the elastic arm portions 82 of the card 80 are engaged with the pair of engaging notch portions 65 provided in the vertical portion 64 of the movable iron piece 60, respectively. The latching pawls 74 and 75 of the movable touch piece 73 are latched to the remaining end edge portion 83 of the card 80. The box-shaped cover 90 is fitted into the base 10, and then sealed by injecting a sealing material which is not illustrated into the bottom of the base 10. Finally, gas inside the base is degassed through the degassing hole 92 of the box-shaped cover 90, and then the degassing hole 92 is subjected to heat caulking. Assembling work is thereby completed.

Figure 7A:
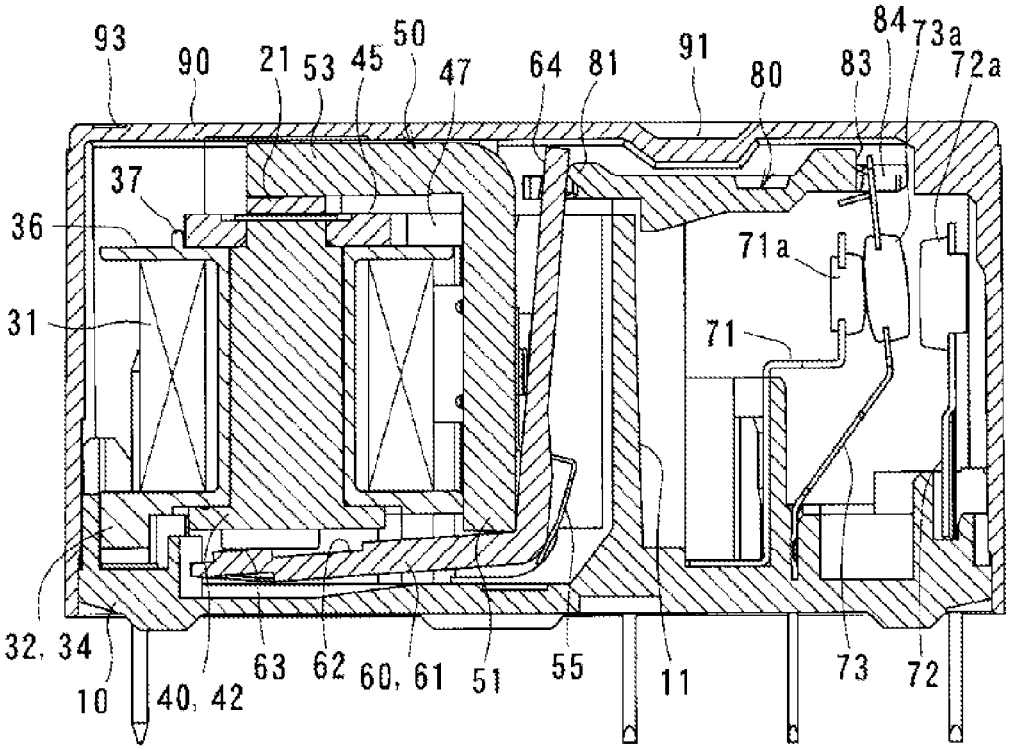
FIGS. 7A and 7B are cross-sectional views illustrating states of the electromagnetic relay before and after the electromagnetic relay operates as illustrated in FIGS. 1A and 1B.
Figure 8A:
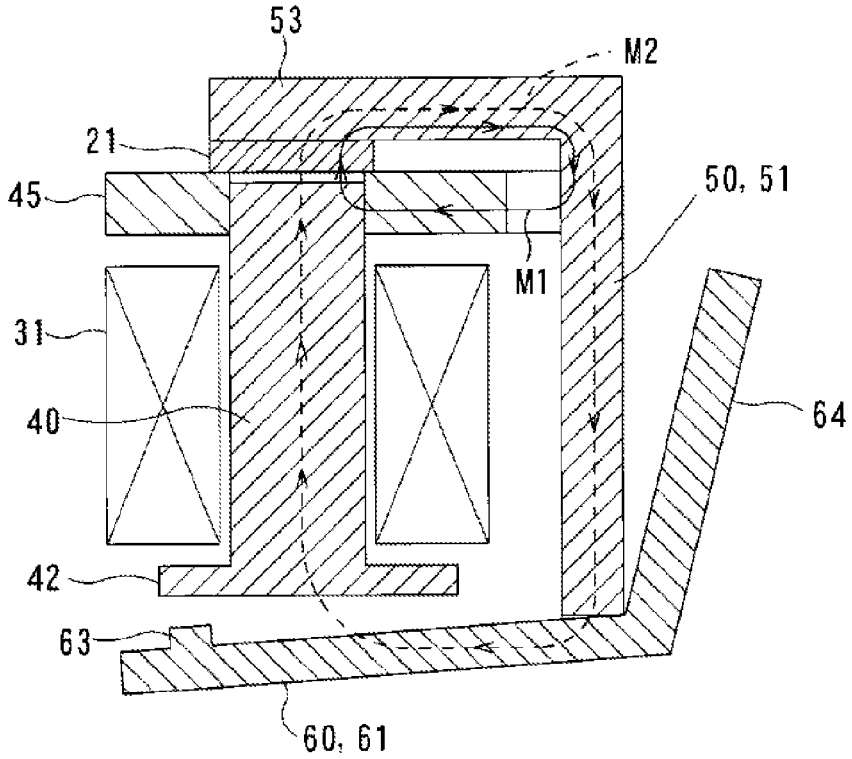
FIGS. 8A and 8B are schematic cross-sectional views describing an operation process of the electromagnet device.
Figure 8B:
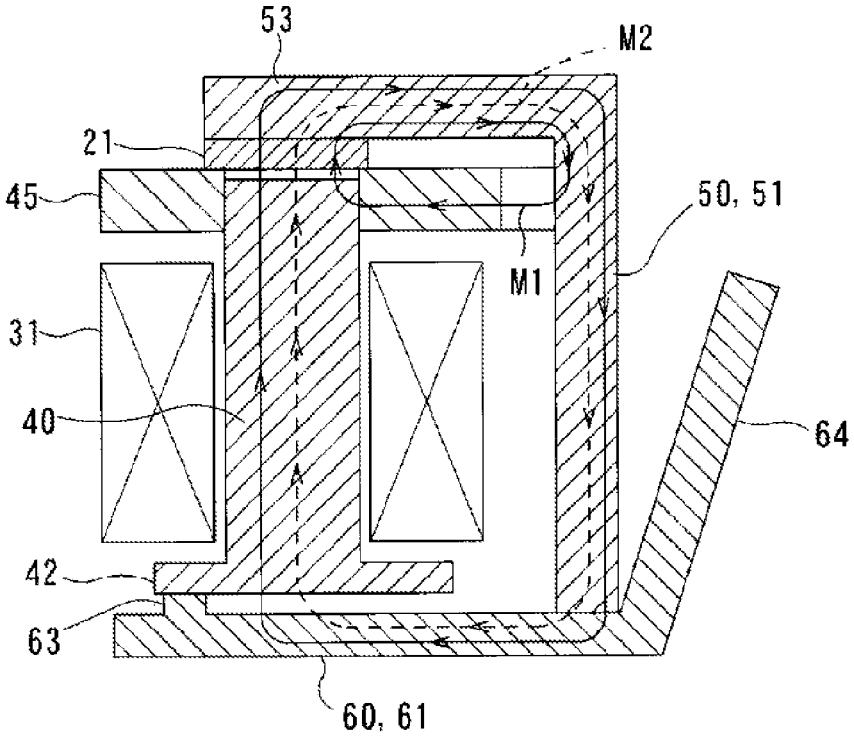

Next, an operation of the magnetic relay having the above-described structure will be described in accordance with one of the preferred embodiments of the present invention as illustrated in FIG. 7A, when a voltage is not applied to the coil 31, while the contact protrusion 63 of the movable iron piece 60 is separated from the magnetic pole portion 42 of the iron core 40, and the movable contact 73*a* is in contact with the first fixed contact 71*a*. During this state the magnetic flux of the permanent magnet 21, as illustrated in FIG. 8A, the magnetic flux of the permanent magnet 21 flows through an auxiliary magnetic circuit M1 which is constructed of the auxiliary yoke 45, and leakage flux forms a main magnetic circuit M2 via the yoke 50. For this reason, a returned state of the movable iron piece 60 is maintained by balance between a spring force of the movable touch piece 73 and the magnetism generated by the magnetic flux which flows to the magnetic circuits M1 and M2. The auxiliary magnetic circuit M1 is in a magnetically saturated state.

Figure 7B:
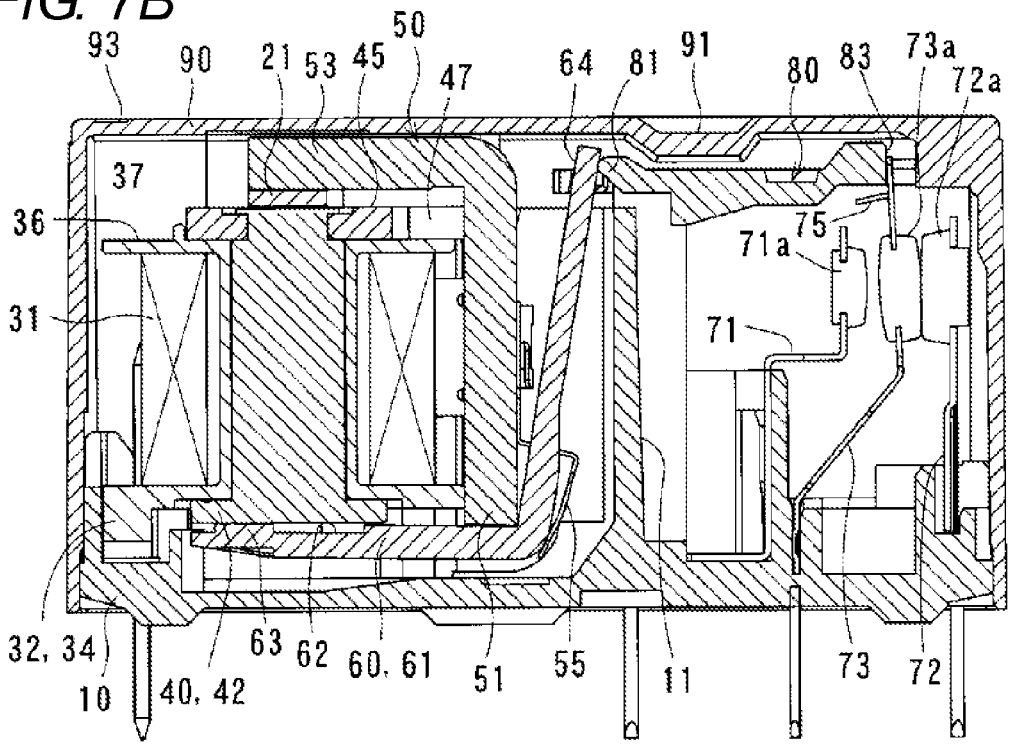

When the voltage is applied so that magnetic flux of the same direction as the magnetic flux of the permanent magnet 21 is generated in the coil 31, the magnetic flux generated by the voltage applied to the coil 31 flows to the magnetic circuit M2 (FIG. 8B), and an attraction force which attracts the movable iron piece 60 increases. For this reason, the movable iron piece 60 is attracted to the magnetic pole portion 42 of the iron core 40, resisting against the spring force of the movable touch piece 73 so the contact protrusion 63 is attracted to the magnetic pole portion 42. For this reason, the vertical portion 64 of the movable iron piece 60 presses the movable touch piece 73 via the card 80, and the movable contact 73*a* separates from the first fixed contact 71*a* and comes into contact with the second fixed contact 72*a* (FIG. 7B).

Figure 9A:
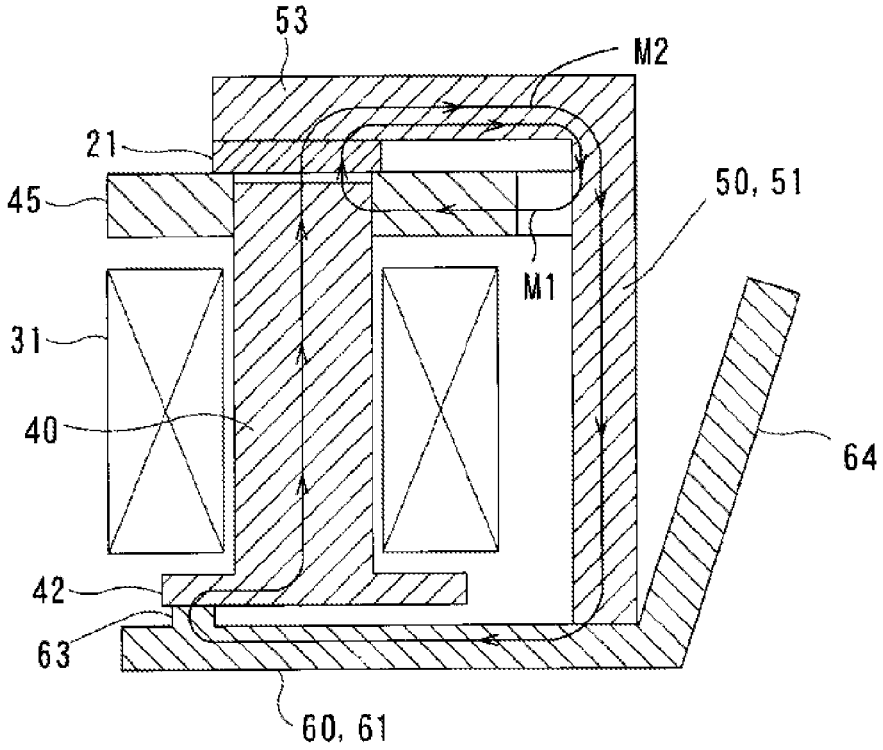
FIGS. 9A and 9B are schematic cross-sectional views describing an operation process of the electromagnet device which is subsequent to the operation process illustrated in FIGS. 8A and 8B.
Figure 9B:
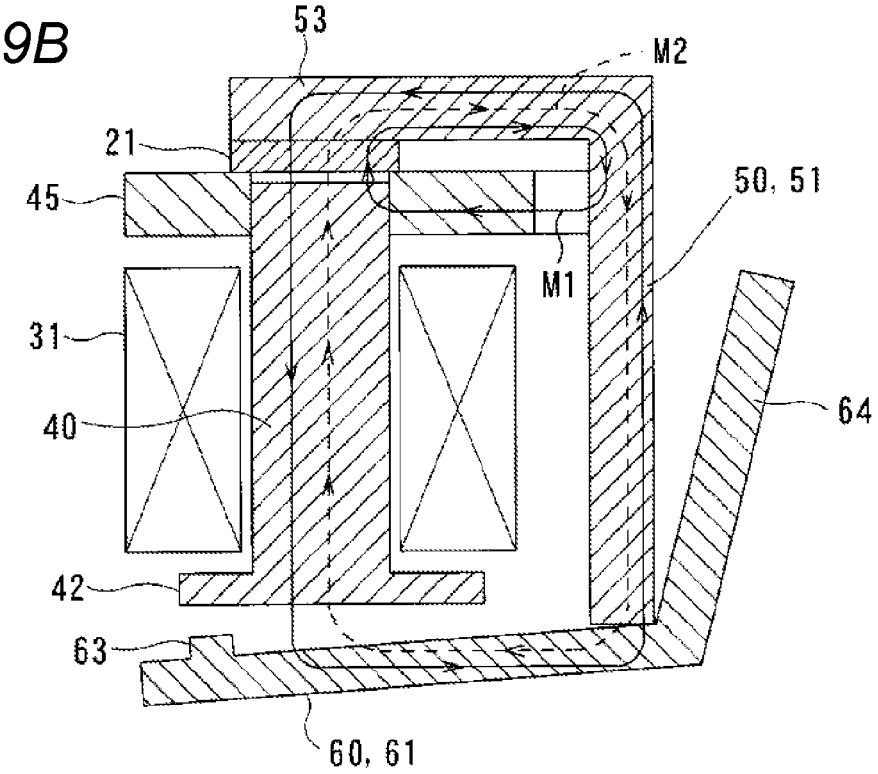
Figure 10A:
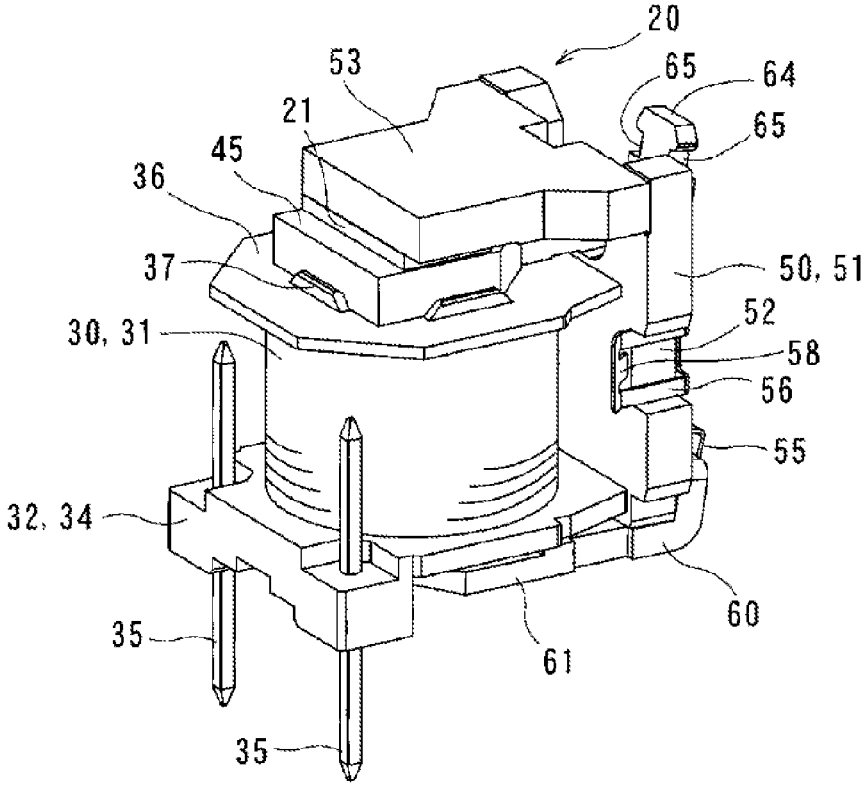
FIGS. 10A and 10B are perspective views of an electromagnet device according to a second embodiment of the invention.
Figure 10B:
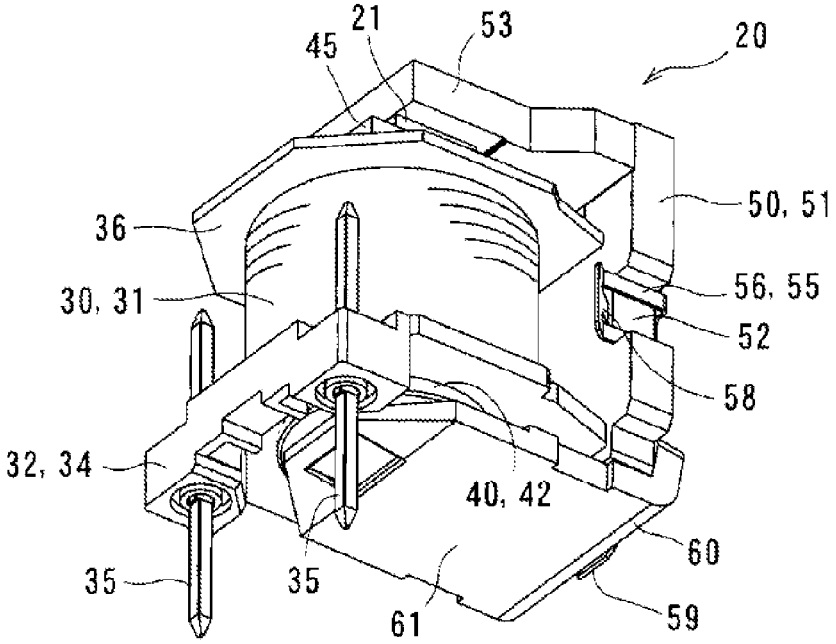

Subsequently, even though the application of the voltage to the coil 31 is stopped, as illustrated in FIG. 9A, a combined magnetic force of the magnetic flux which flows in the auxiliary magnetic circuit M1 which is constructed of the auxiliary yoke 45 from the permanent magnet 21, and the magnetic flux which flows in the main magnetic circuit M2 which is constructed of the yoke 50, the movable iron piece 60, and the iron core 40 is larger than the spring force of the movable touch piece 73. For this reason, the movable iron piece 60 maintains the present state, without pivoting.

When a return voltage of a reversed direction which is reversed to the previously described application voltage is applied to the coil 31 (refer to FIG. 9B), such that the magnetism of the permanent magnet 21 acting on the movable iron piece 60 will be canceled. Further the movable contact 73*a* separates from the second fixed contact 72*a* and comes into contact with the first fixed contact 71*a*, thereby returns to the original returned state.

Even though the return voltage is applied in the present embodiment, since the auxiliary magnetic circuit M1 which is constructed of the auxiliary yoke 45 is in a magnetically saturated state, the magnetic flux does not flow in the auxiliary magnetic circuit M1. For this reason, since the whole magnetic flux in the coil 31 which is generated by the applied return voltage flows in the main magnetic circuit M2 which is constructed of the yoke 50, the movable iron piece 60, and the iron core 40, and a return operation is carried out, there is an advantage that a latching type electromagnetic relay consuming less power is obtainable.

According to the present embodiment, in a moved state wherein an operation voltage is applied and movement is stopped, the movable iron piece is retained by a combined magnetic force of a magnetic flux flowing through the auxiliary magnetic circuit and a magnetic flux flowing through the main magnetic circuit. Accordingly, due to effective usage of the magnetic flux of the permanent magnet an electromagnet device having a strong retaining force to retain the movable iron piece in a moved state can be obtained. Further, there is an advantage that the magnetism of the permanent magnet is effectively used and thus a latching type electromagnetic relay with a strong retaining force for retaining the movable iron piece which is in a moved state can be obtained.

Figure 11:
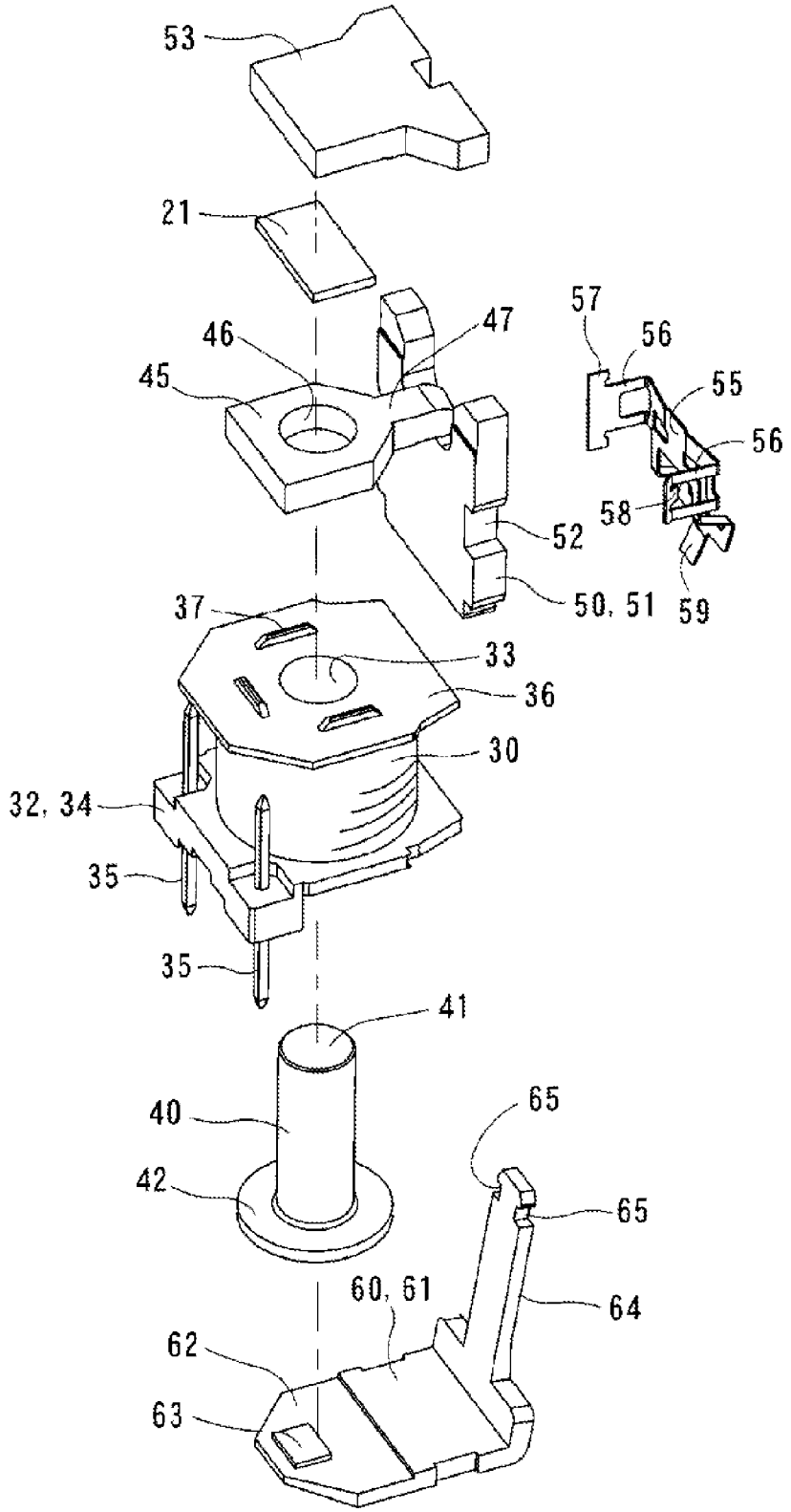
FIG. 11 is an exploded perspective view of the electromagnet device, illustrated in FIG. 10A, which is obliquely viewed from the top.
Figure 12:
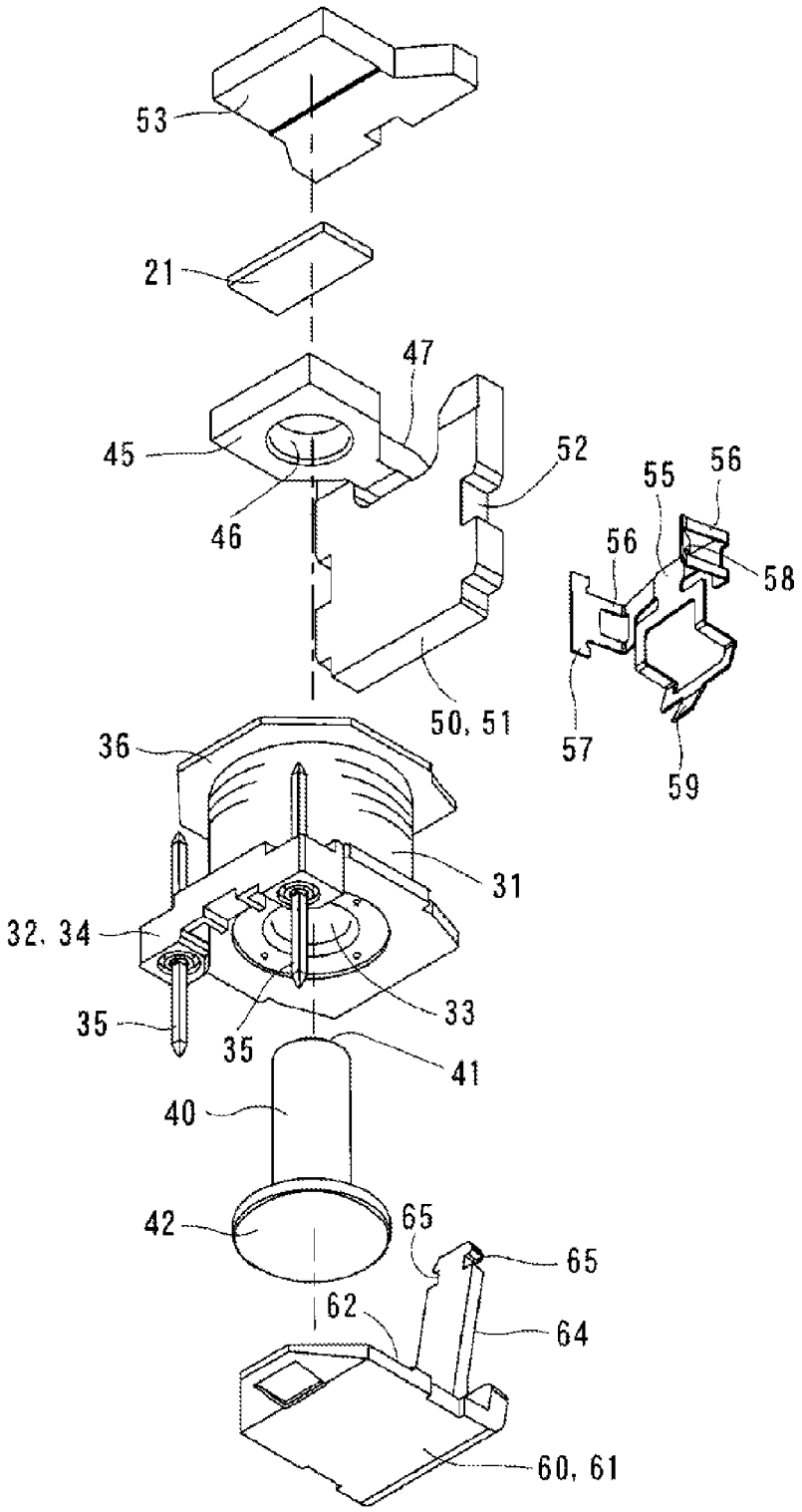
FIG. 12 is an exploded perspective view of the electromagnet device, illustrated FIG. 10B, which is obliquely viewed from the bottom.
Figure 13A:
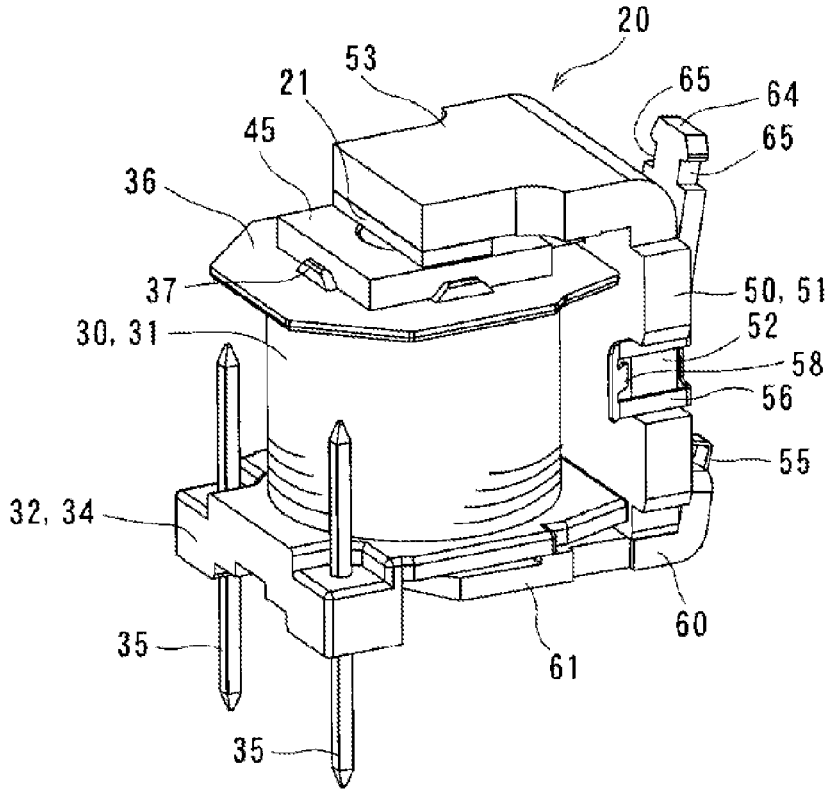
FIGS. 13A and 13B are perspective views of an electromagnet device according to a third embodiment of the invention.
Figure 13B:
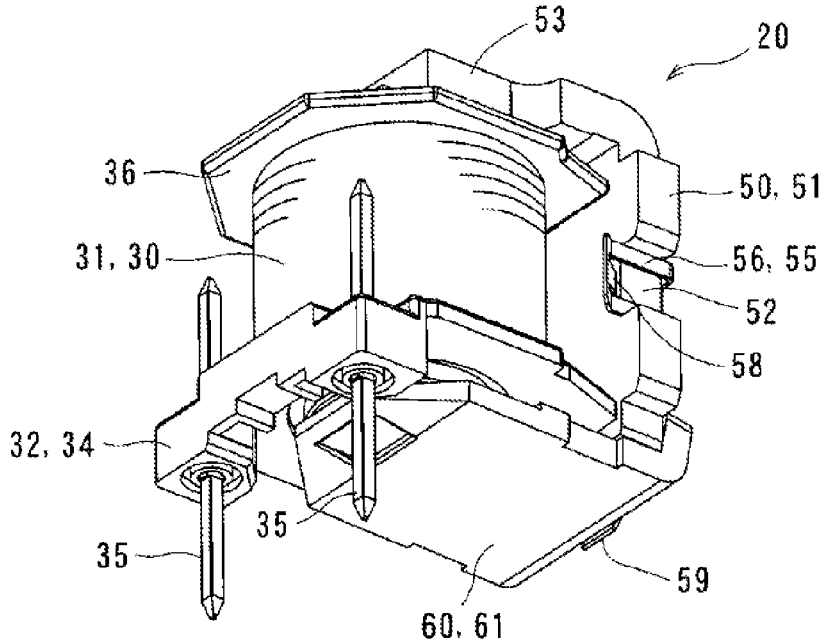
Figure 14:
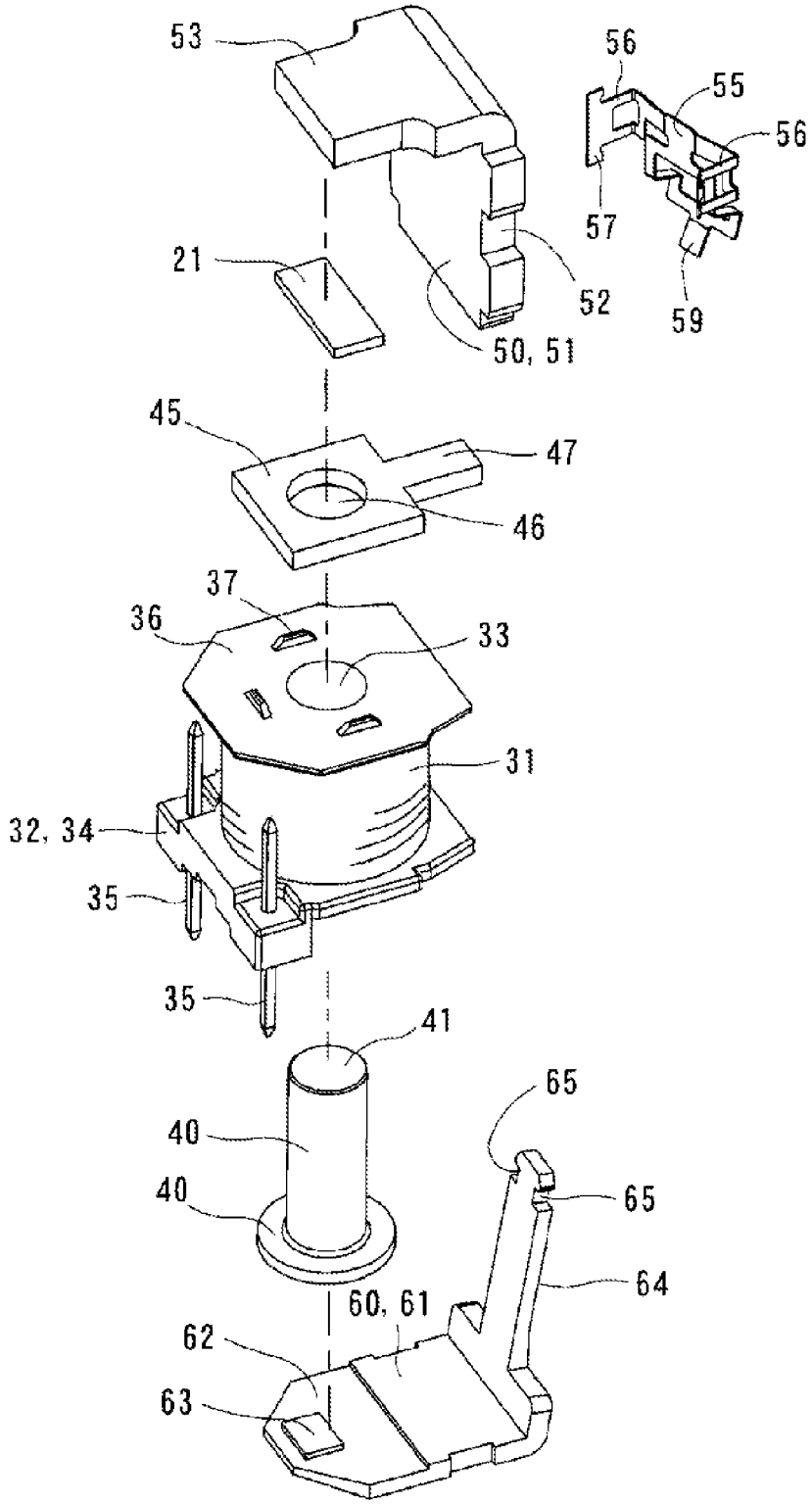
FIG. 14 is an exploded perspective view of the electromagnet device, illustrated in FIG. 13A, which is obliquely viewed from the top.

An electromagnet device according to a second embodiment is similar to the first embodiment as illustrated in FIGS. 10A, 10B, 11, and 12. Therefore similar details are not described herein below for sake of brevity. The FIGS. 11 and 12 illustrates the differential features of the second embodiment such as a horizontal portion 53 of a yoke 50 is provided as a separate body, and an auxiliary yoke 45 provided with a connection narrow-width portion 47 which is a magnetic resistance portion of a smaller cross-sectional area than a base portion (a wide-width portion without including a caulking hole 46) and is integrally bent and raised from a center of an upper end portion of the yoke 50. A spool 32 and the yoke 50 are unified into a body by passing an iron core 40 through a central hole 33 of the spool 32 and by caulking-fixing an upper end portion 41 of the iron core 40 which is passed through to a caulking hole 46 of the auxiliary yoke 45. And an auxiliary magnetic circuit M1 is formed as a structure in which a permanent magnet 21 is interposed between the auxiliary yoke 45 and a horizontal portion 53 where an end face of the horizontal portion 53 is in face contact with an area within an upper end portion of a vertical portion 51 of the yoke 50. Because other portions are the same as those of the first embodiment, like portions are denoted by like reference signs and a detailed description thereof is not given.

According to the present embodiment, there are advantages that the iron core 40 and the yoke 50 can be assembled with high assembling accuracy, and an electromagnet device 20 with a small variation in operating characteristic is obtainable. Further, since the magnetic flux of the permanent magnet also flows in the auxiliary magnetic circuit which is formed via the magnetic resistance portion with a small cross-sectional area of the auxiliary yoke, an electromagnet device which can easily maintain a returned state of the movable iron pieces as well as a moved state is obtained.

Figure 15:
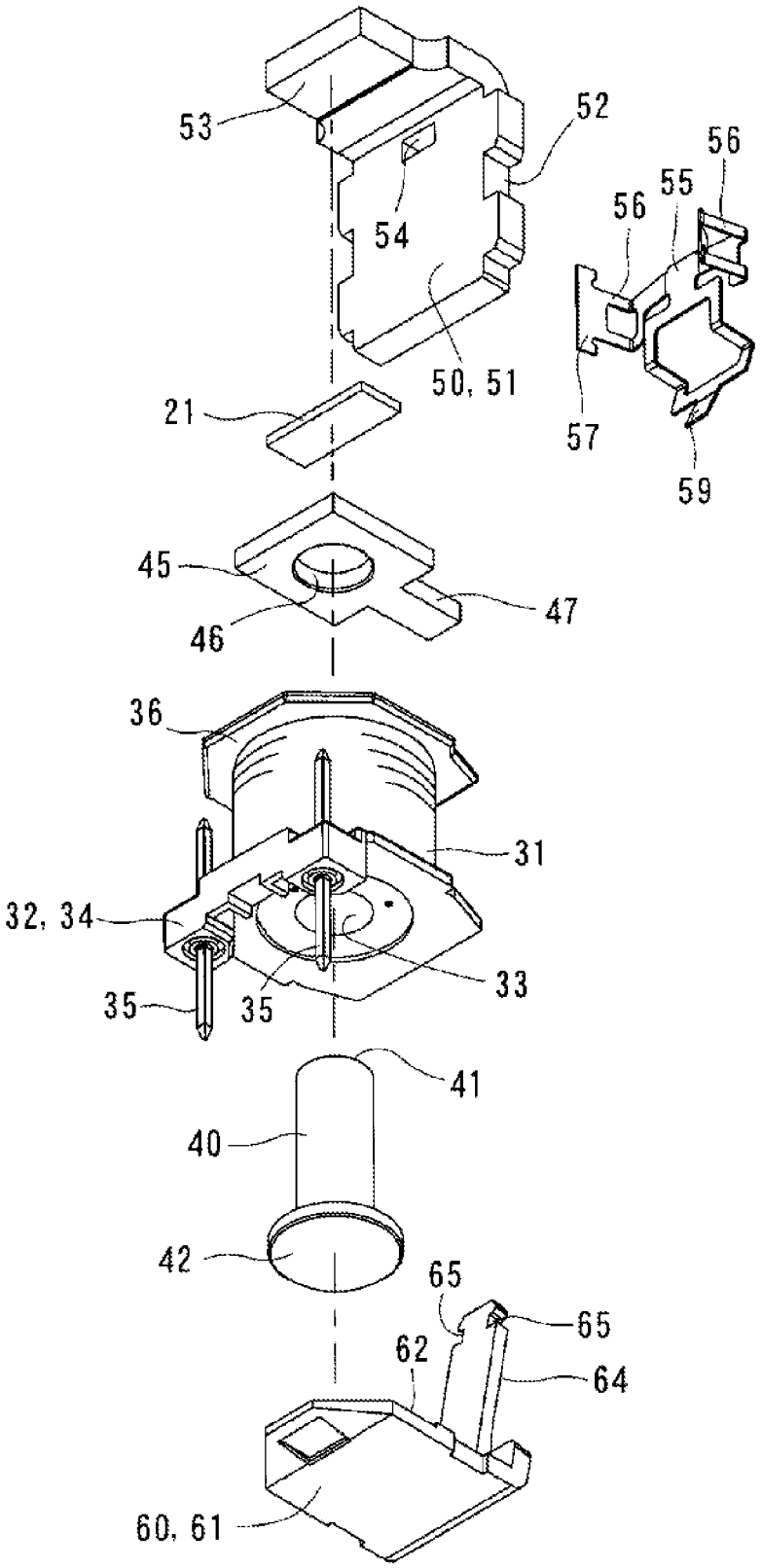
FIG. 15 is an exploded perspective view of the electromagnet device, illustrated FIG. 13B, which is obliquely viewed from the bottom.

An electromagnet device according to a third embodiment is similar to the first embodiment almost as illustrated in FIGS. 13A, 13B, 14, and 15. Therefore similar details are not described herein below for sake of brevity. The FIG. 15 illustrates the differential features of the third embodiment such as unification is achieved by fitting a connection narrow-width portion 47 which is a magnetic resistance portion with a small cross-sectional area compared with a cross section of a base portion (a wide-width portion without including a caulking hole 46) of an auxiliary yoke 45 which extends sideways from a center of an end portion of the auxiliary yoke 45 into a fitting hole 54 provided in a vertical portion 51 of a yoke 50.

According to the present embodiment, the permanent magnet 21 can be interposed between a horizontal portion 53 of the yoke 50 and the auxiliary yoke 45 in advance by fitting the connection narrow-width portion 47 of the auxiliary yoke 45 which is caulking-fixed to an upper end portion 41 of an iron core 40 into the fitting hole 54 provided in the vertical portion 51 of yoke 50 for the purpose of unification. Accordingly, there is an advantage that assembling work becomes easy and work performance improves. Further, according to the present embodiment, alignment accuracy of the permanent magnet with respect to the auxiliary yoke as well as alignment accuracy of the auxiliary yoke improves, and an electromagnet device with a small variation in operating characteristic is obtained.

Figure 16:
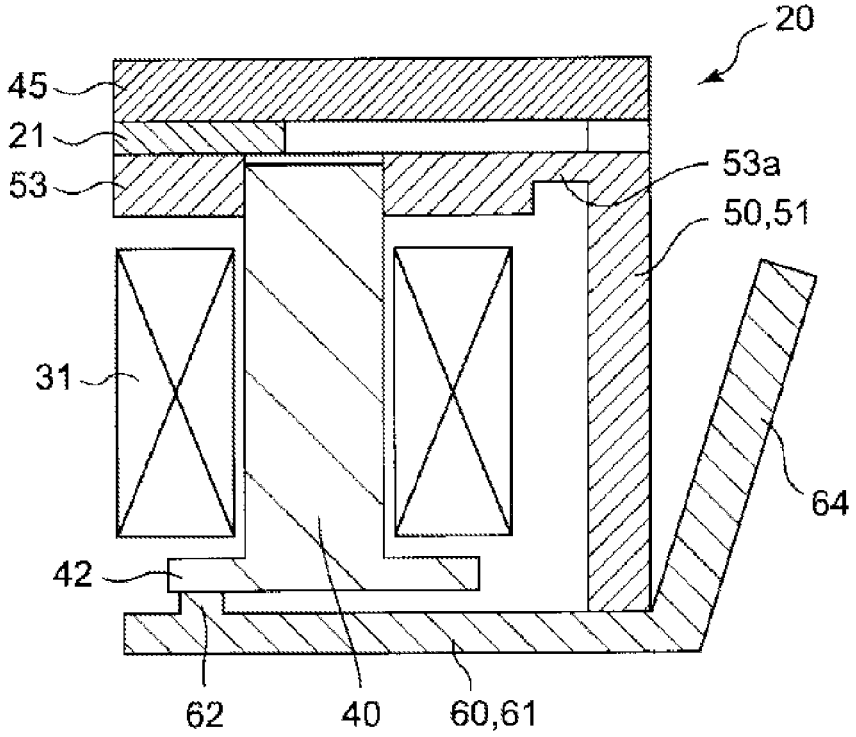
FIG. 16 is a schematic cross-sectional view of an electromagnet device according to a fourth embodiment of the invention.

An electromagnet device according to a fourth embodiment has a structure in which a permanent magnet 21 is interposed between a horizontal portion 53 extending from an end of a vertical portion 51 of a yoke 50 and an auxiliary yoke 45 joined to an upper end surface of the vertical portion 51 of the yoke 50, as schematically illustrated in FIG. 16. And a connection narrow-width portion 53*a* which is a magnetic resistance portion having a small cross-sectional area compared with a cross section of a base portion is provided in the base portion of the horizontal portion 53 of the yoke 50. Because other portions are the same as those of the first embodiment, like portions are denoted by like reference signs and detailed description thereof is not given.

According to the present embodiment, since the permanent magnet is interposed between the auxiliary yoke, and the horizontal portion of the yoke which is integrally formed through a cutting process so as to extend via the magnetic resistance portion with a small cross-sectional area, an electromagnet device which has a sufficient magnetic efficiency and leaks a small amount of the magnetic flux is obtained.

Figure 17:
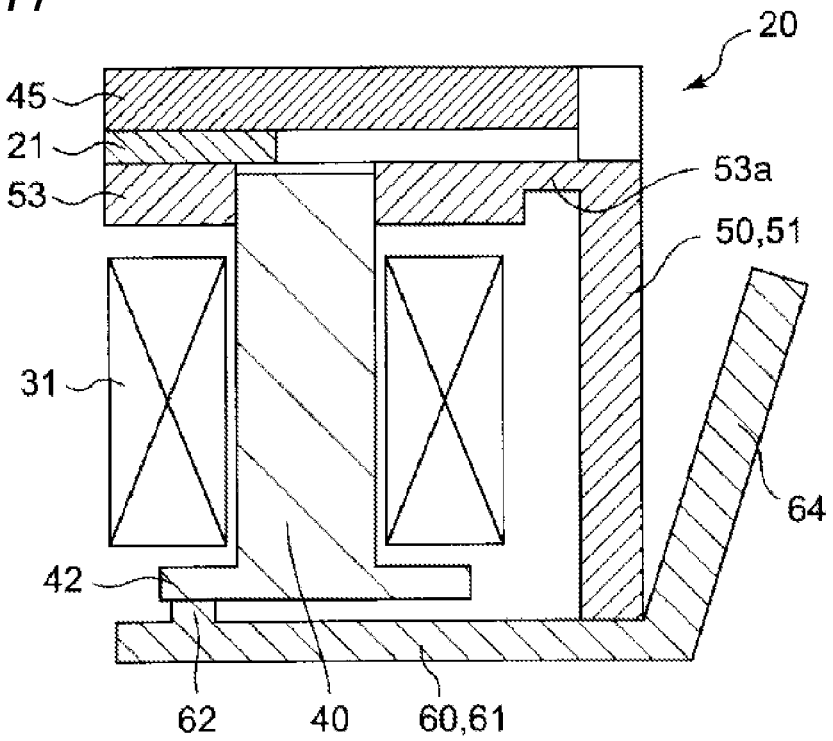
FIG. 17 is a schematic cross-sectional view of an electromagnet device according to a fifth embodiment of the invention.

A magnetic circuit may be formed according to a fifth embodiment as illustrated in FIG. 17. That is, a permanent magnet is interposed between a horizontal portion 53 extending from an upper end of a vertical portion 51 of a yoke 50, and an auxiliary yoke 45 which is supported so that an end portion of the auxiliary yoke 45 is joined to an inside surface of an upper end portion of the vertical portion 51 of the yoke 50. And a connection narrow-width portion 53*a* which is a magnetic resistance portion having a small cross-sectional area compared with a cross section of a base portion is provided in the base portion of the horizontal portion 53 of the yoke 50.

According to the present embodiment, the auxiliary magnetic circuit where the magnetic flux of the permanent magnet is saturated is formed as a structure in which the horizontal portion of the yoke and the auxiliary yoke are connected to each other via the magnetic resistance portion with a small cross-sectional area. Accordingly, an electromagnet device which easily maintains the returned state of the movable iron piece is obtained.

Figure 18:
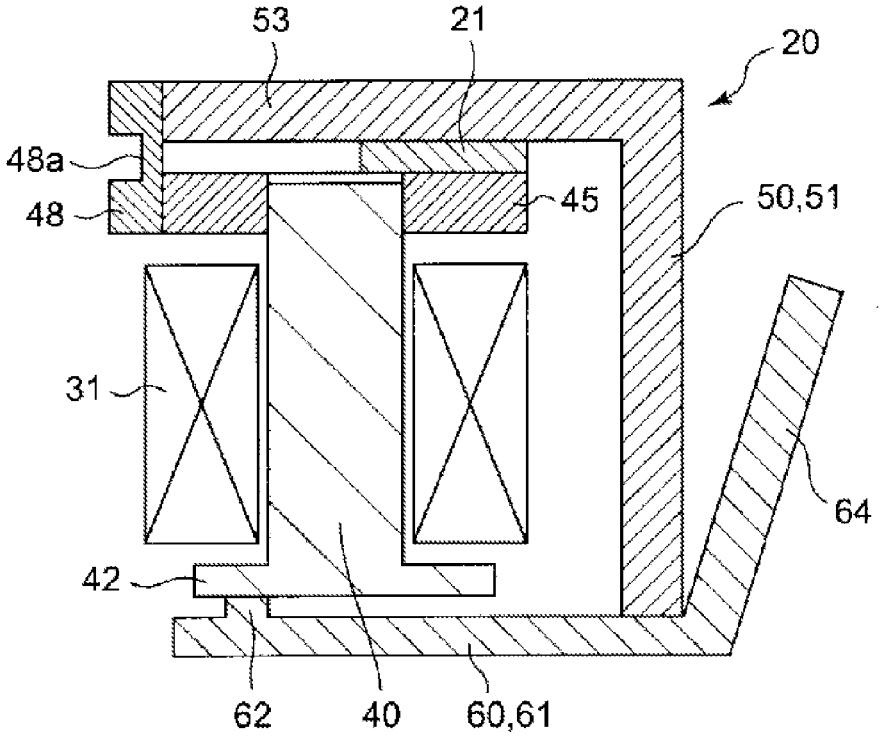
FIG. 18 is a schematic cross-sectional view of an electromagnet device according to a sixth embodiment of the invention.

An auxiliary magnetic circuit M1 may be formed according to a sixth embodiment as illustrated in FIG. 18, wherein a permanent magnet 21 is interposed between a horizontal portion 53 of a yoke 50 and an auxiliary yoke 45 which is caulking-fixed to an iron core 40, the auxiliary yoke 45 and the horizontal portion 53 are connected to each other via a second auxiliary yoke 48 which has a connection narrow-width portion 48*a*, serving as a magnetic resistance portion with a small cross-sectional area compared with a cross section of a base portion of the auxiliary yoke 45.

According to the present embodiment, the auxiliary magnetic circuit is formed via the magnetic resistance portion with a small cross-sectional area which is provided in the one end portion of the iron core. Accordingly, the magnetic resistance portion with a small cross-sectional area needs not be provided in the yoke or the auxiliary yoke, and therefore a degree of freedom in design increases.

Figure 19:
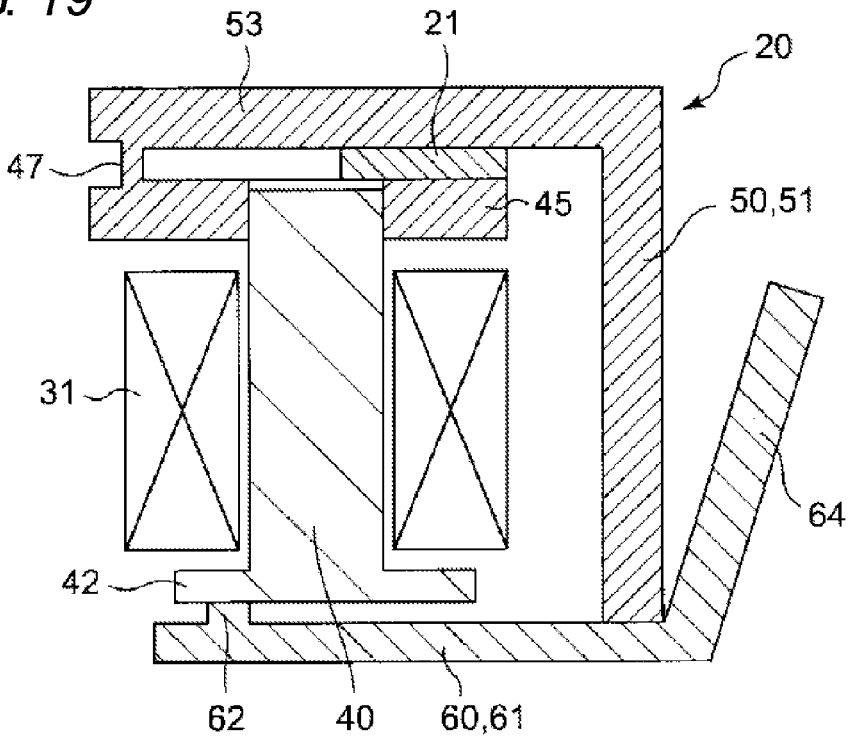
FIG. 19 is a schematic cross-sectional view of an electromagnet device according to a seventh embodiment of the invention.

In accordance with a seventh embodiment as illustrated in FIG. 19, an auxiliary yoke 45 extends from a leading end portion of a horizontal portion 53 of a yoke 50, via a connection narrow-width portion 47 which serves as a magnetic resistance portion with a small cross-sectional area compared with a cross section of a base portion of the auxiliary yoke 45. And an auxiliary magnetic circuit M1 may be formed as a structure in which a permanent magnet 21 is interposed between the horizontal portion 53 of the yoke 50, and the auxiliary yoke 45 which is caulking-fixed to an iron core 40.

Figure 20B:
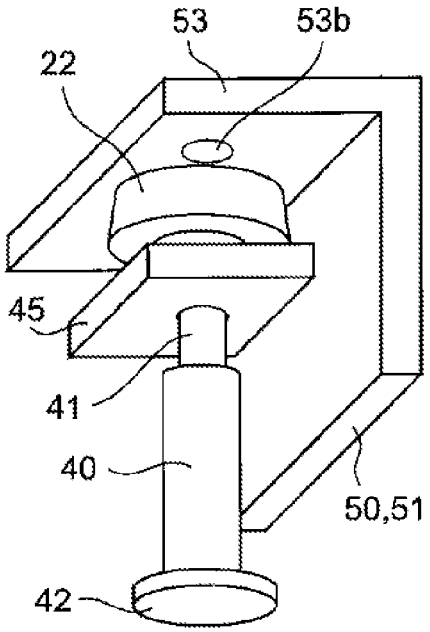
FIGS. 20A and 20B are schematic cross-sectional and exploded perspective views, respectively, of an electromagnet device according to an eighth embodiment of the invention.
Figure 20A:
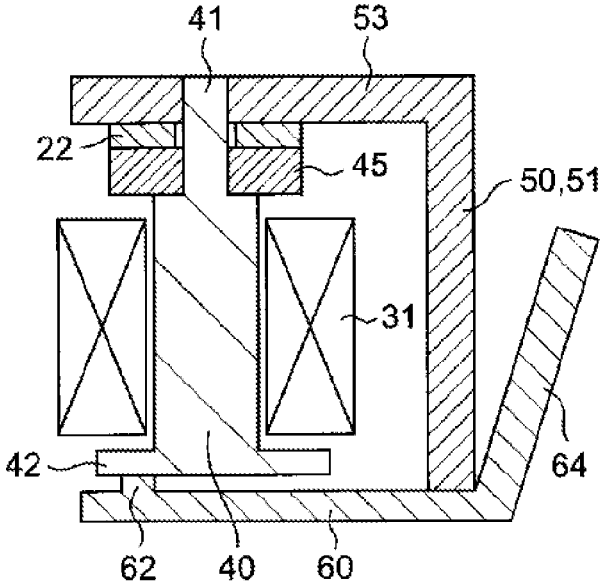

The permanent magnet 21 is not necessarily a plate-like magnet, but may be an annular magnet as illustrated in FIG. 20 (an eighth embodiment). In the present embodiment, the permanent magnet 21 may be interposed between a horizontal portion 53 of a yoke 50 and an auxiliary yoke 45 in such a manner that an upper end portion 41 of an iron core 40 is inserted and passed through a through-hole of the auxiliary yoke and then the annular permanent magnet 22, and further caulking-fixed to a caulking hole 53*b* provided in the horizontal portion 53. In the present embodiment, the upper end portion 41 of the iron core 40 functions as a magnetic resistance portion with a small cross-sectional area compared with a cross section of a base portion of the iron core 40.

Figure 21B:
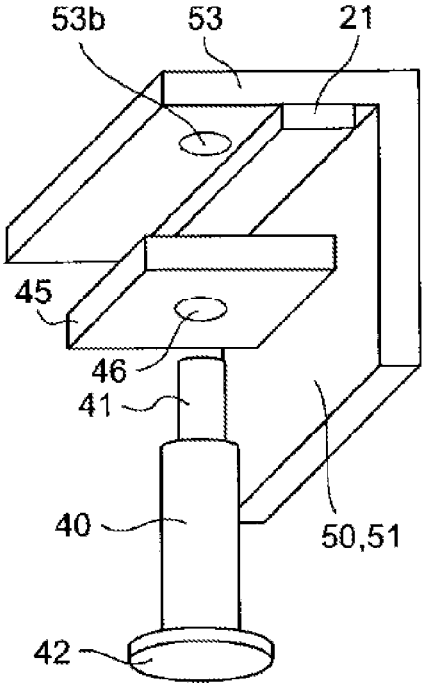
FIGS. 21A and 21B are schematic cross-sectional and exploded perspective views, respectively, of an electromagnet device according to a ninth embodiment of the invention.
Figure 21A:
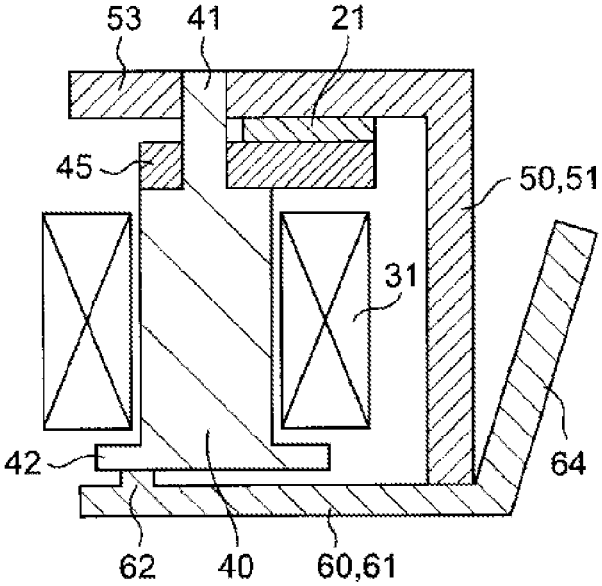

When an upper end portion 41 of an iron core 40 is used as a magnetic resistance portion with a small cross-sectional area compared with a cross section of a base portion of the iron core 40, as illustrated in FIG. 21, a permanent magnet 21 may be interposed between a horizontal portion 53 of a yoke 50 and an auxiliary yoke 45 (a ninth embodiment).

Figure 22B:
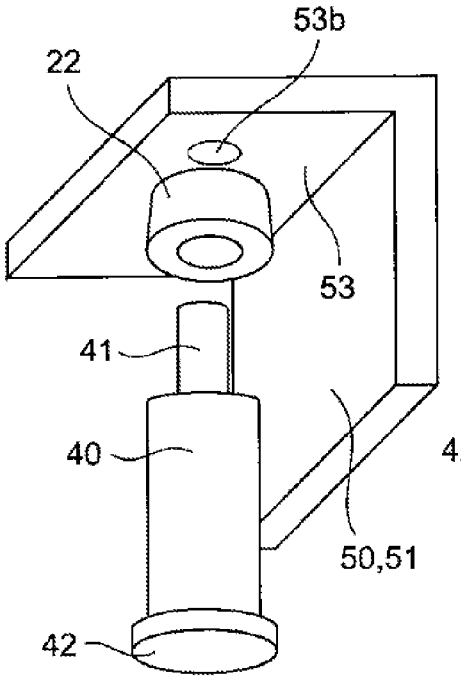
FIG. 22B is a schematic exploded perspective view of an electromagnet device according to a tenth embodiment of the invention.
Figure 22A:
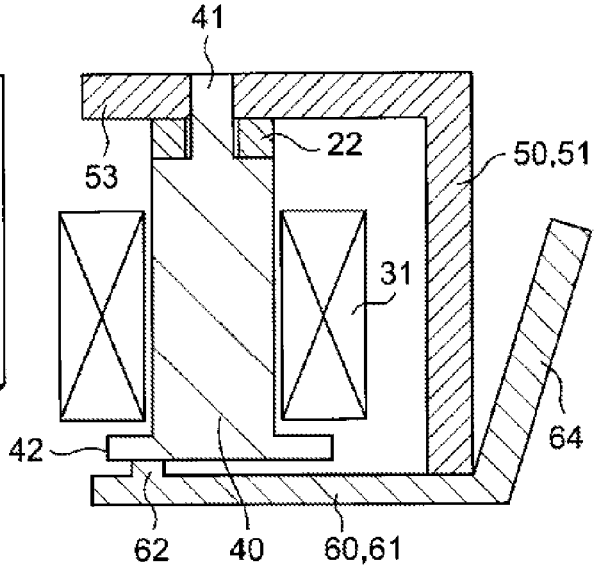
FIG. 22A is a schematic cross-sectional view of an electromagnet device according to a tenth embodiment of the invention.

When the upper end portion 41 of the iron core 40 is used as a magnetic resistance portion with a small cross-sectional area compared with a cross section of the base portion of the iron core 40, as illustrated in FIG. 22, the auxiliary yoke 45 is not necessarily included. That is, an annular permanent magnet 22 through which an iron core 40 is passed may be interposed between a horizontal portion 53 of a yoke 50 and the iron core 40 having an upper end portion 41 which is caulking-fixed to a caulking hole 53*b* provided in a horizontal portion 53 (a tenth embodiment). According to the present embodiment, there is an advantage that an electromagnet device that can be produced with high productivity can be obtained because the number of parts and the number of assembling steps are decreased.

It is needless to say that the electromagnet device according to the present invention is applied not only to an electromagnetic relay but also to other electronic equipment.

There has thus been shown and described an electromagnetic device and electromagnetic relay using the same which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electromagnet device comprising:

a horizontal portion of a yoke arranged near one end portion of an iron core;

a movable iron piece pivotably supported on a leading end edge portion of a vertical portion of the yoke;

an end portion of the movable iron piece adapted to be attracted to a magnetic pole portion by a main magnetic circuit, the magnetic pole portion is arranged in the other end portion of the iron core, where the main magnetic circuit is formed by applying a voltage to a coil wound around a periphery of the iron core; and an auxiliary magnetic circuit formed in parallel with the main magnetic circuit, the auxiliary magnetic circuit comprises an auxiliary yoke including a magnetic resistance portion extending directly therefrom, and a permanent magnet arranged near the one end portion of the iron core and the magnetic resistance portion in which a magnetic flux of the permanent magnet is magnetically saturated.

2. The electromagnet device according to claim 1, wherein the auxiliary magnetic circuit comprises:

the permanent magnet interposed between the horizontal portion of the yoke and an auxiliary yoke such that the auxiliary yoke is fixed to the one end portion of the iron core, and at least one narrow-width portion extending sideways from one end of the auxiliary yoke and joined to the vertical portion of the yoke.

3. The electromagnet device according to claim 2, wherein the auxiliary magnetic circuit comprises a pair of the narrow-width portions that extend sideways in parallel with each other from the one end portion of the auxiliary yoke and are joined to the vertical portion of the yoke.

4. The electromagnet device according to claim 1, wherein the auxiliary magnetic circuit comprises:

the horizontal portion of the yoke and the vertical portion of the yoke formed as separate bodies, an auxiliary yoke fixed to the one end portion of the iron core, the auxiliary yoke integrally extends from an end portion of the vertical portion of the yoke via a narrow-width portion, and the permanent magnet is interposed between the horizontal portion of the yoke and the auxiliary yoke.

5. The electromagnet device according to claim 1, wherein the auxiliary magnetic circuit comprises the one end portion of the iron core fixed to the horizontal portion of the yoke which extends from an end portion of the vertical portion of the yoke via a narrow-width portion, and the permanent magnet is interposed between the auxiliary yoke and the horizontal portion of the yoke, wherein the auxiliary yoke is joined to a leading end face of the vertical portion of the yoke.

6. The electromagnet device according to claim 1, wherein the auxiliary magnetic circuit comprises:

the one end portion of the iron core fixed to the horizontal portion of the yoke which extends from an end portion of the vertical portion of the yoke via a narrow-width portion, and the permanent magnet is interposed between an auxiliary yoke and the horizontal portion of the yoke, wherein the auxiliary yoke includes an end portion fixed to an end side face of the vertical portion of the yoke.

7. The electromagnet device according to claim 1, wherein the auxiliary magnetic circuit comprises:

the permanent magnet interposed between the horizontal portion of the yoke and the auxiliary yoke fixed to the one end portion of the iron core, and an end portion of the auxiliary yoke joined to a leading end portion of the horizontal portion via an auxiliary member provided with a narrow-width portion.

8. The electromagnet device according to claim 1, wherein the auxiliary magnetic circuit comprises:

the permanent magnet interposed between the horizontal portion of the yoke and an auxiliary yoke fixed to the one end portion of the iron core, and an end portion of the auxiliary yoke unified with a leading end portion of the horizontal portion via a narrow-width portion.

9. The electromagnet device according to claim 1, wherein the auxiliary magnetic circuit comprises:

the one end portion of the iron core used as a magnetic resistance portion and having a small cross-sectional area as compared with a cross section of a base portion of the iron core, the permanent magnet having an annular shape, the permanent magnet interposed between the horizontal portion of the yoke and the auxiliary yoke, the iron core inserted and passed through the permanent magnet via a through-hole of the auxiliary yoke, and the one end portion of the iron core, which is passed through, is fixed to the horizontal portion of the yoke.

10. The electromagnet device according to claim 1, wherein the auxiliary magnetic circuit comprises:

the one end portion of the iron core used as a magnetic resistance portion with a small cross-sectional area compared with a cross section of a base portion of the iron core, the permanent magnet interposed between the horizontal portion of the yoke and the auxiliary yoke, and the one end portion of the iron core inserted and passed through a through hole of the auxiliary yoke and fixed to the horizontal portion of the yoke.

11. The electromagnet device according to claim 1, wherein the auxiliary magnetic circuit comprises the one end portion of the iron core used as a magnetic resistance portion and having a small cross-sectional area as compared with a cross section of a base portion of the iron core, the permanent magnet having an annular shape, the one end portion of the iron core inserted and passed through the permanent magnet and the one end portion of the iron core, which is passed through, fixed to the horizontal portion of the yoke.

12. An electromagnetic relay comprising:

the electromagnet device according to claim 1, and a contact mechanism arranged to be adjacent to the electromagnet device, and adapted to be driven via a card connected to a movable iron piece of the electromagnet device.

13. An electromagnetic relay comprising:

the electromagnet device according to claim 2, and a contact mechanism arranged to be adjacent to the electromagnet device, and adapted to be driven via a card connected to a movable iron piece of the electromagnet device.

14. An electromagnetic relay comprising:

the electromagnet device according to claim 4, and a contact mechanism arranged to be adjacent to the electromagnet device, and adapted to be driven via a card connected to a movable iron piece of the electromagnet device.

15. An electromagnetic relay comprising:

the electromagnet device according to claim 5, and a contact mechanism arranged to be adjacent to the electromagnet device, and adapted to be driven via a card connected to a movable iron piece of the electromagnet device.

16. An electromagnetic relay comprising:

the electromagnet device according to claim 6, and a contact mechanism arranged to be adjacent to the electromagnet device, and adapted to be driven via a card connected to a movable iron piece of the electromagnet device.

17. An electromagnetic relay comprising:

the electromagnet device according to claim 7, and a contact mechanism arranged to be adjacent to the electromagnet device, and adapted to be driven via a card connected to a movable iron piece of the electromagnet device.

18. An electromagnetic relay comprising:

the electromagnet device according to claim 8, and a contact mechanism arranged to be adjacent to the electromagnet device, and adapted to be driven via a card connected to a movable iron piece of the electromagnet device.

19. An electromagnetic relay comprising:

the electromagnet device according to claim 9, and a contact mechanism arranged to be adjacent to the electromagnet device, and adapted to be driven via a card connected to a movable iron piece of the electromagnet device.

20. An electromagnetic relay comprising:

the electromagnet device according to claim 10, and a contact mechanism arranged to be adjacent to the electromagnet device, and adapted to be driven via a card connected to a movable iron piece of the electromagnet device.

* * * * *